US005204716A

United States Patent [19]

Kasahara et al.

[11] Patent Number: 5,204,716

[45] Date of Patent: Apr. 20, 1993

[54] SIDE-FREE RECORDING APPARATUS

[75] Inventors: Nobuo Kasahara; Katsuo Sakai, both of Yokohama, Japan

[73] Assignee: Ricoh Company, Ltd., Tokyo, Japan

[21] Appl. No.: 742,725

[22] Filed: Aug. 6, 1991

Related U.S. Application Data

[63] Continuation of Ser. No. 443,434, Nov. 30, 1989, abandoned.

[30] Foreign Application Priority Data

Dec. 5, 1988 [JP] Japan ..... 63-306065
Feb. 16, 1989 [JP] Japan ..... 1-37081
May 24, 1989 [JP] Japan ..... 1-130466

[51] Int. Cl.[5] ..... G03G 15/00

[52] U.S. Cl. ..... 355/24; 355/274; 355/275; 355/326

[58] Field of Search ..... 355/271, 272, 275, 281, 355/290, 326, 327, 319, 24, 274, 273

[56] References Cited

U.S. PATENT DOCUMENTS 3,697,170 10/1972 Bhagat et al. ..... 355/274 X
4,448,872 5/1984 Vandervalk ..... 355/277 X
4,538,901 9/1985 Soumiya ..... 355/273
4,714,939 12/1987 Ahern et al. ..... 355/275
4,937,630 6/1990 Yoshikawa et al. ..... 355/271 X
5,138,363 8/1992 Yuge ..... 355/24

FOREIGN PATENT DOCUMENTS 2062591 7/1971 Fed. Rep. of Germany .
1368456 9/1974 United Kingdom .
8702792 5/1987 World Int. Prop. O. .

OTHER PUBLICATIONS

Ronald A. Andrews, "Single Pass Duplex in Electronic Systems", Jan./Feb. 1984, *Xerox Disclosure Journal*, vol. 9, No. 1.

*Primary Examiner*—A. T. Grimley
*Assistant Examiner*—J. E. Barlow, Jr.
*Attorney, Agent, or Firm*—Oblon, Spivak, McClelland, Maier & Neustadt

[57] ABSTRACT

An image recording apparatus capable of forming an image freely on the front side and the back side of a paper sheet and applicable to a laser printer, digital copier, etc. A toner image is formed on either one or both of a photoconductive element and an intermediate transfer body in the form of a belt and transferred to the adjoining side of a paper sheet. The paper sheet carrying a toner image on one or both sides thereof is fixed when passed through a fixing section only once.

12 Claims, 23 Drawing Sheets

SIDE-FREE RECORDING APPARATUS

This application is a continuation of application Ser. No. 07/443,434, filed on Nov. 30, 1989, now abandoned.

BACKGROUND OF THE INVENTION

The present invention relates to an image recording apparatus capable of forming images freely on opposite sides a paper sheet and, more particularly, to an image recording apparatus applicable to a laser printer, digital copier, etc.

There has been known an electrophotographic copier of the type having a single photoconductive drum and forming a toner image on the drum, transferring the toner image to a paper sheet, fixing it on the paper sheet, and stacking such paper sheets or copiers in a predetermined position. In this type of copier, paper sheets to which toner images have been transferred from the above in the image transfer process are always stacked face up, while paper sheets to which toner images have been transferred from the below are stacked face down without exception. This obstructs efficient arrangement of pages and cannot meet user's various needs. Some approaches have heretofore been proposed to cope with such a situation, as disclosed in Japanese Patent Laid-Open Publication (Kokai) No. 57-63559 and Japanese Utility Model Laid-Open Publication (Kokai) No. 58-166650 by way of example. One of the prior art approaches is to locate means for turning over a paper sheet on a paper transport path. Another prior art approach is to dispose two photoconductive drums face to face and transfer toner images to opposite sides of a paper sheet when the latter is moved through between the two drums.

A problem with the turn-over scheme stated above is that an extra period of time is needed to turn over paper sheets one by one, resulting in low copy productivity. Further, since a two-sided copy is moved back and forth two times through a fixing station, the copy is apt to suffer from various undesirable occurrences ascribable to thermal contraction, e.g., deviation of images, creasing and folding. On the other hand, the two drum scheme is capable of effecting side-free copying without the need for extra reversing means. Nevertheless, the two drums and their associated developing means and other various means render the overall construction of the recording apparatus bulky and complicated.

SUMMARY OF THE INVENTION

It is therefore an object of the present invention to provided a simple and compact image recording apparatus which does not use reversing means.

It is another object of the present invention to provide an image recording apparatus which allows images to be fixed on opposite sides of a paper sheet at the same time by passing the paper sheet through a fixing station only once.

It is another object of the present invention to provide a generally improved image recording apparatus.

An image recording apparatus capable of forming an image freely on front-side and the back side of a recording sheet of the present invention comprises an image carrier carrying an electrostatically formed latent image representative of an image to be recorded, an image forming unit for forming the latent image on the image carrier as a non-invented image or an inverted image, a developing unit for developing latent image formed on the image carrier by the image forming unit to produce a primary toner image, an intermediate transfer body located to face the image carrier for moving the recording sheet between the intermediate transfer body and the image carrier, a primary toner image transferring unit for transferring the primary toner image to the recording sheet from the image carrier an intermediate transferring unit for transferring the primary toner image to the intermediate transfer body to form an secondary toner image on the intermediate transfer body, a polarity inverting unit for inverting either a polarity of the primary toner image or a polarity of the secondary toner image, and a secondary toner image transferring unit for transferring the secondary toner image to the recording sheet from the intermediate transfer body.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
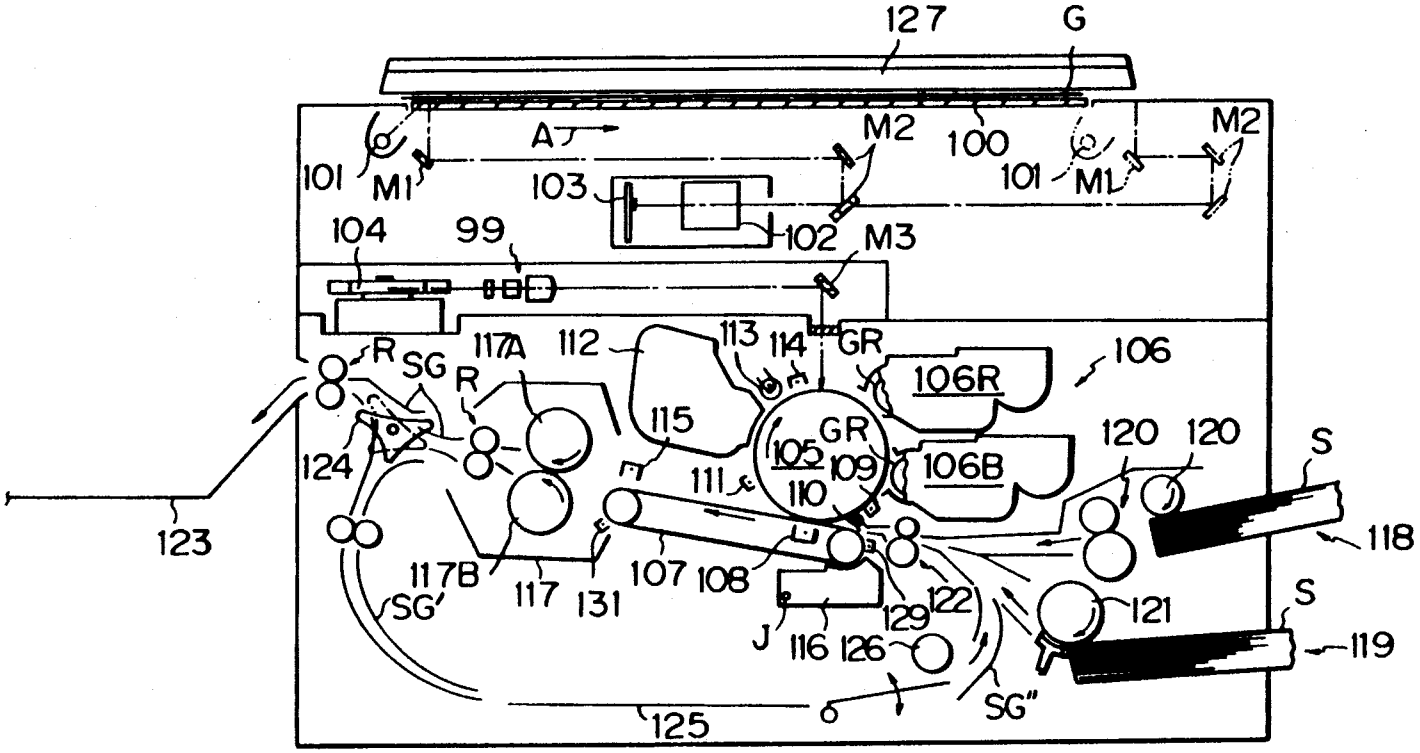
FIG. 1 is a schematic view of a recording apparatus to which the present invention is advantageously applicable.

Referring to FIG. 1 of the drawings, a recording apparatus to which the present invention is advantageously applicable is shown which is generally made up of document reading means, optical writing means, image forming means, fixing means, paper feeding means, and paper transporting means.

The document reading means has a glass platen 100 to be loaded with an original document G, a cover plate 127 for covering th document G and glass platen 100 from above, a lamp 101 for illuminating the document G, a first mirror M1 movable integrally with the lamp 101 in a scanning direction A, mirrors M2 movable in the scanning direction A in interlocked relation to the first mirror M1, and a color imaging device 103. An automatic document feeder may or may not be mounted on the top of the copier, although not shown in the figure. When the document reading means scans the document G, information representative of the document G is subjected to color separation by the color imaging device 103, converted into a digital signal, and then stored in storing means, not shown.

The optical writing means has means for causing a semiconductor laser drive current to entrain the document data stored in the storing means, a semiconductor laser, a rotatable mirror 104 for steering a beam issuing from the laser in the event of scanning, optics 99 including an F-theta lens, and a mirror M3 for directing the beam toward a photoconductive drum 105. The drum 105 may be implemented by OPC, Se or CdS. Since the optical writing means stores image information in the form of a digital signal, the writing sequence may be varied to write a mirror-inverted image or a non-inverted image on the drum 105, as desired.

The image forming means has, in addition to the drum 105, developing means 106 for developing a latent image written on the drum 105 by the writing means to produce a primary toner image, an intermediate image transfer member in the form of a belt 107 which allows a paper sheet to move between itself and the drum 105, and a charger 108 interposed between the upper and lower runs of the belt 107 and facing the drum 105. The belt 107 is implemented by a dielectric film such as a polyester film (50 microns to 150 microns) or a tetrafluorovinyliden film. The drum 105 and belt 107 are driven in synchronism with each other by a servo motor so as to prevent an image from being dislocated.

Also included in the image forming means are a pretransfer charger 109, a discharger 110, a precleaning discharger 111, a cleaner 112, a discharger 113, and a main charger 114 which are arranged in this order around the drum 105. Arranged around the belt 107 are a charger 115 located above the left end of the belt 107, a charger 131 located downstream of the charger 115 with respect to the intended direction of rotation of the belt 107, a cleaner 116 disposed below the right end of the belt 107, and a charger 129 positioned downstream of the cleaner 116 and upstream of the charger 108.

Figure 2:
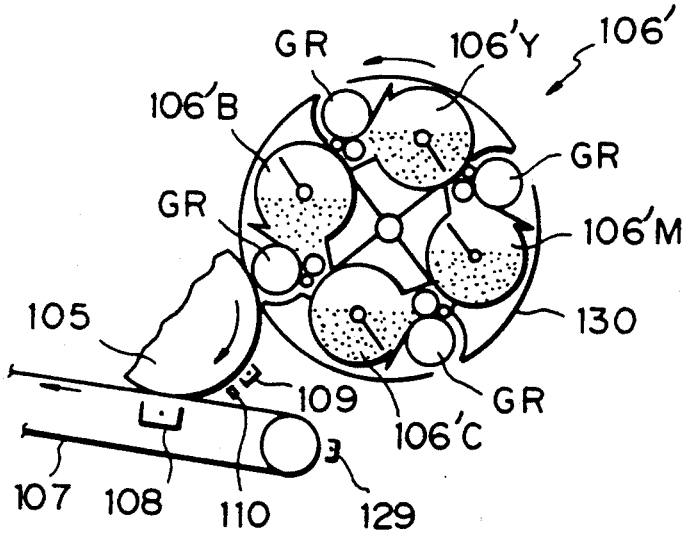
FIG. 2 is a schematic section of developing means.

In FIG. 1, the developing means 106 is shown as comprising two independent developing units 106R and 106B which are loaded with a red toner and a black toner, respectively. The developing means 106, therefore, is operable to record images in two different colors. Each of the developing units 106R and 106B includes a developing roller GR. To implement full-color image recording, developing units each being loaded with respective one of cyan, magenta and yellow toners are arranged in predetermined developing positions around the drum 105 or, as shown in FIG. 2, use is made of alternative developing means 106'. This developing means 106' is constituted by a rotatable hollow cylinder 130 which is partitioned into four compartments, and four developing units each being accommodated in respective one of the compartments, i.e., a developing unit 106'Y storing a yellow toner, a developing unit 106'M storing a magenta toner, a developing unit 106'C storing a cyan toner, and a developing unit 106'B storing a black toner. The cylinder 130 is rotatable to bring one of the developing units 106'Y, 106'M, 106'C and 106'B to a position where it faces the drum 105, when a latent image to be developed by that developing unit arrives there.

Referring again to FIG. 1, the cleaner 116 is rotatable about a fulcrum J and moved toward and away from the belt 107 to clean the belt 107 as needed.

The fixing means, generally 117, is implemented by a pair of rollers 117A and 117B located downstream of the belt 107 and made of rubber, for example. The fixing means 117 fixes a toner image on a paper sheet coming out of the belt 107 by applying heat thereto.

The paper feeding means has paper cassettes 118 and 119 each being loaded with a stack of paper sheets S, separating rollers 120 and 121, and a register roller 122.

The paper transporting means has a paper guide SG extending from the fixing means 117 to a stacking section 123, a feed roller pair R, a selector in the form of pawl 124 located at an intermediate portion of the paper guide SG, a paper guide SG' extending from the selector 124 to the register roller 122, an intermediate stacking section 125, a feed roller 126 for feeding a recycled paper sheet, and a paper guide SG" extending between the feed roller 126 and the register roller 122. The belt 107 itself is so located as to interconnect the register roller 122 and fixing means 117 and, in this sense, it may regarded as playing the role of a paper transporting means as well.

Two different paper transport modes are available with the copier shown in FIG. 1, i.e., a one-pass mode and a recycle mode. In the one-pass mode, a paper sheet S fed from one of the paper cassettes 118 and 119 is routed through register roller 122, belt 107, fixing means 117, and selector 124 which is positioned as indicated by a phantom line to the stacking section 123. On the other hand, in the recycle mode, the paper sheet S from the cassette 118 or 119 is routed through the register roller 122, belt 107, fixing means 117, and the selector 124 which is positioned as indicated by a solid line to the intermediate stacking section 125, then returned to the register roller 122 by the feed roller 126, and then driven out to the stacking section 123 via the fixing means 117. These two different modes are selectively executed as desired.

Specific examples of image forming methods will be described hereinafter. While all the methods which will be described are implemented by essentially the same construction shown in FIGS. 1 and 2, the construction is partly differs from one method to another, as will be described also.

EXAMPLE 1

This example is characterized by the processes shown in FIGS. 3 to 8. With this example, it is possible to form an image by any of methods 1 to 5 which will be described.

METHOD 1 (SEE FIGS. 1 AND 3)

Mode

Method 1 is usable to form a monochromatic image on the surface of a paper sheet and is effected in a monochromatic one-side mode. This mode is selected by a button switch provided on an operation board and executed by control means which is constituted by a CPU (Central Processing Unit).

Figure 3:
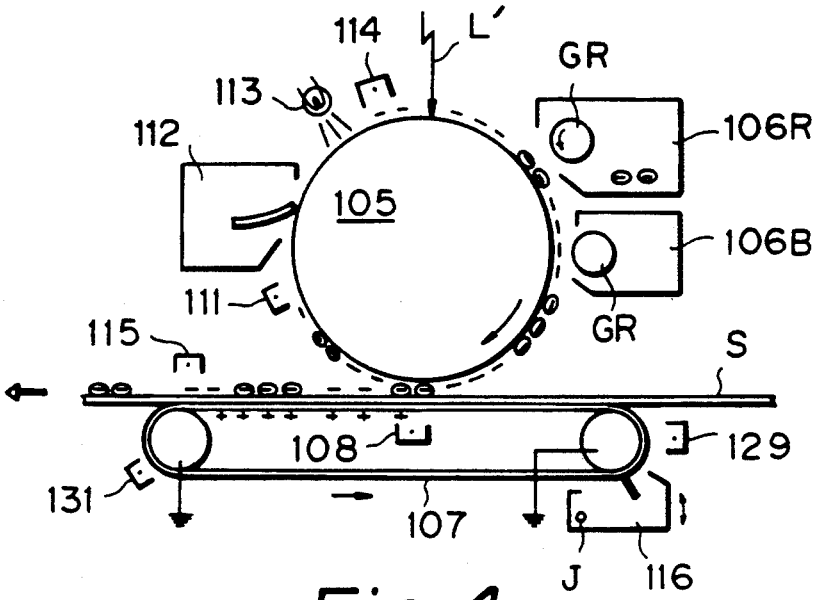
FIGS. 3 to 26 are schematic views demonstrating various image forming modes.

In FIG. 3, AC and negative DC are applied to the charger 115 for causing it to separate a paper sheet from the belt 107. However, the charger 115 is not activated in this particular mode. AC and DC are superposed and applied to the chargers 131 and 129 so that the chargers 131 and 129 may discharge the surface of the belt 107 beforehand to prepare it for polarity inversion and invert the polarity of the discharged belt surface, respectively. In this mode, the charges 131 and 129 are not activated, either.

Process

As the drum 105 is rotated, the main charger 114 uniformly charges the drum 105 to negative polarity in the dark. Then, imagewise light L' propagated through the optical writing means scans the surface of the drum 105 to erase the charge in an image area. More specifically, the imagewise light L' writes an inverted latent image on the drum 105 so that it may be reproduced on a paper sheet as a non-inverted image. The developing unit 106R develops the latent image by the negatively charged red toner to produced a primary toner image. When a black image is desired, the black developing unit 106B will be used. In FIG. 3 and successive figures, the polarities of toner particles are indicated by signs with circles. The leading edge of the primary toner image meets that of a paper sheet S which is driven by the register roller 122 at a predetermined timing, at the charger 108. The charger 108 transfers the primary toner image to the surface of the paper sheet S by positive corona discharge of which is opposite in polarity to the toner. In this example, therefore, the charger 108 constitutes primary toner image transferring means. The paper sheet S carrying the primary toner image on the surface thereof is separated from the belt 107 and then routed through the fixing means 117 to the stacking section 123 face up. After the image transfer, the belt 107 is cleaned by the cleaner 116 to prepare for another process. The cleaner 116 is provided because toner particles sometimes remain on the belt 107 depending on the paper size. On the other hand, the surface of the drum 105 is discharged by the precleaning charger 111, cleaned by the cleaner 112 to remove residual toner particles, and then discharged by the discharger 113.

Advantage of Method 1

Since a single image transferring process suffices, a document can be reproduced without any damage to an image, as with a prior art monochromatic copier.

METHOD 2 (SEE FIGS. 1, 4 AND 5)

Mode

This method forms a monochromatic image on the back of a paper sheet and is executed in a monochromatic one-side mode. This method is selected in the same manner as Method 1. In this method, AC and positive DC are applied to the charger 129 while the process is under way. The chargers 115, 129 and 131 are activated. The rest of the mode is the same as the mode of Method 1.

Process

Figure 4:
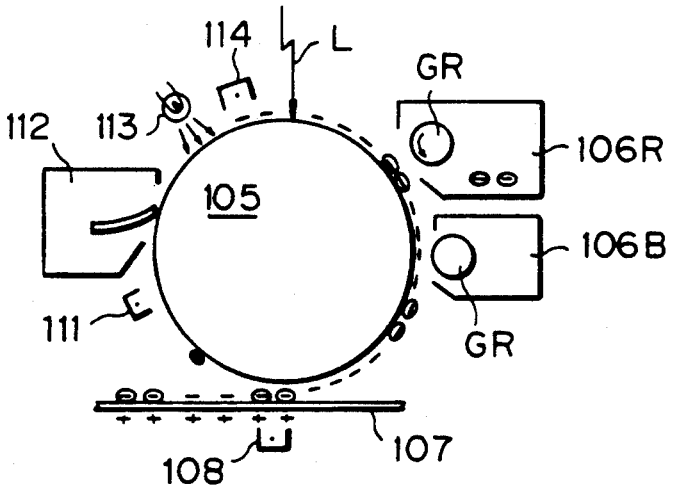
Figure 5:
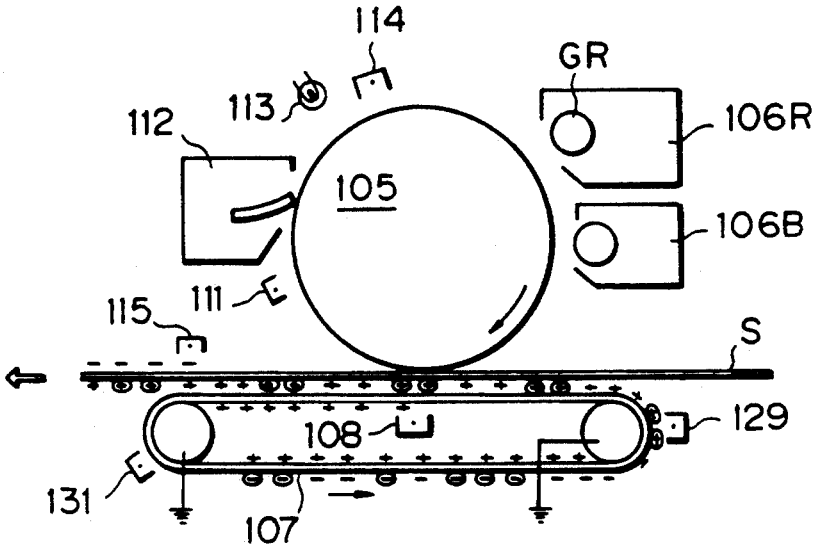
Figure 6:
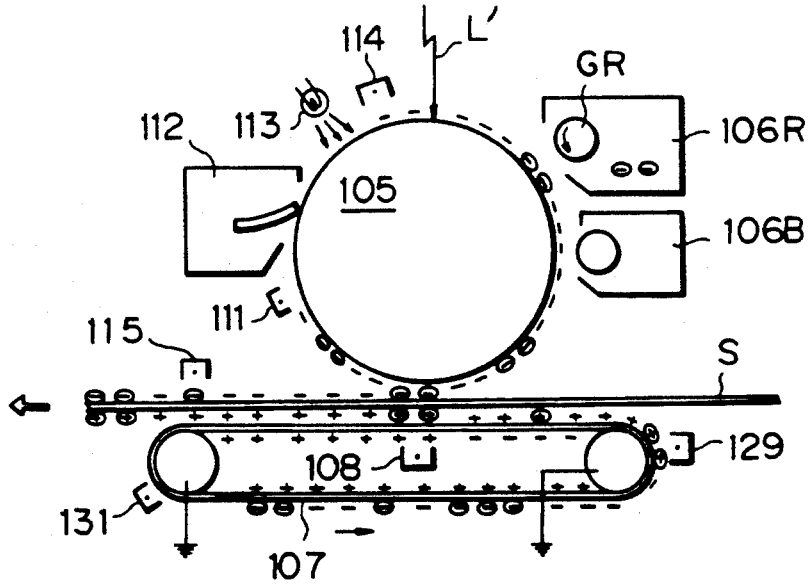

Referring FIG. 4, the drum 105 is uniformly charged to negative polarity and then scanned by imagewise light L which is propagated through the optical writing means. The imagewise light writes a non-inverted latent image on the drum 105 so that a non-inverted image may be reproduced on a paper sheet. The latent image is developed by the developing unit 106R which stores a negatively charged red toner, whereby a primary toner image is produced on the drum 105. When a black image is desired, the developing unit 106B will be used. The primary toner image is transferred to the belt 107 as an inverted secondary toner image by the positive corona discharge of the charger 108 which is opposite in polarity to the toner. In this example, therefore, the charger 108 serves as intermediate transferring means for transferring the primary toner image as the secondary toner image to the belt 107. Subsequently, as shown in FIG. 5, the belt 107 carrying the secondary toner image thereon is discharged by the discharger 131 together with the toner image. After the belt 107 has moved away from the cleaner 116 which is spaced apart from the belt 107, its polarity is inverted to positive by the corona discharge of the charger 129. The resulting positive secondary toner image is transferred by the charger 108 to the back of a paper sheet S which is fed at a predetermined timing. In this example, therefore, the charger 108 plays the role of secondary toner transferring means also. The paper sheet S carrying the secondary toner image on its back is separated from the belt 107 by the charger 115 and then fed to the fixing means 117. The paper sheet S come out of the fixing means 117 is stacked face down on the stacking section 123. The charger 115 bifunctions to discharge the belt 107.

Advantage of Methods 1 and 2

Switching means is accessible for selecting either one of modes associated with Methods 1 and 2, so that a desired image can be formed on either one of opposite sides of a paper sheet. Therefore, when a single reproduction is reproduced with each of a plurality of documents, it is not necessary to arrange the pages of the reproductions. One may want the copies to be stacked in the stacking section face down for privacy or may want them to be stacked face up for immediate checking. Methods 1 and 2 meet both of such needs. While a prior art monochromatic copier has needed independent arrangements for the separation of a paper sheet from a photoconductive drum, transport of the separated paper sheet, etc., in this example the belt 107 functions as an intermediate image transfer body and paper transporting means at the same time. This, coupled with the curvature-based separation, enhances reliable paper transport and, by increasing the copying speed, increases the copy productivity.

METHOD 3 (SEE FIGS. 1, 4 AND 6)

Mode

This method forms monochromatic images on opposite sides of a paper sheet at the same time and is effected in a monochromatic two-side mode. Such a mode is also selected in the same manner as stated in relation to Method 1. Voltages applied to the various chargers are the same as the voltages used in Method 2.

Process

A secondary toner image is formed on the belt 107 by the procedure described in Method 2 (see FIG. 4). At this stage of operation, the chargers 129 and 131 are activated. Then, a primary toner image is formed on the drum 105 by the same procedure as in Method 1. Subsequently, the primary toner image and the secondary toner image are respectively transferred to the surface and the back of a paper sheet S. The sheet S carrying the two images on opposite sides thereof is transported to the fixing means 117.

Advantage of Method 3

A two-sided copy is achievable without resorting to reversing means. This simplifies the construction and increases the copy productivity.

METHOD 4 (SEE FIGS. 1, 2, 4, 7 AND 8)

Mode

This method forms a black-and-red image or a full-color image on the back of a paper sheet and is effected in a one-side color mode. This mode is also selected in the manner described in relation to Method 1. The developing units 106B and 106R and chargers 115, 129 and 131 are activated. The charger 108 is provided with a function of changing the image transfer voltage.

Process

Figure 7:
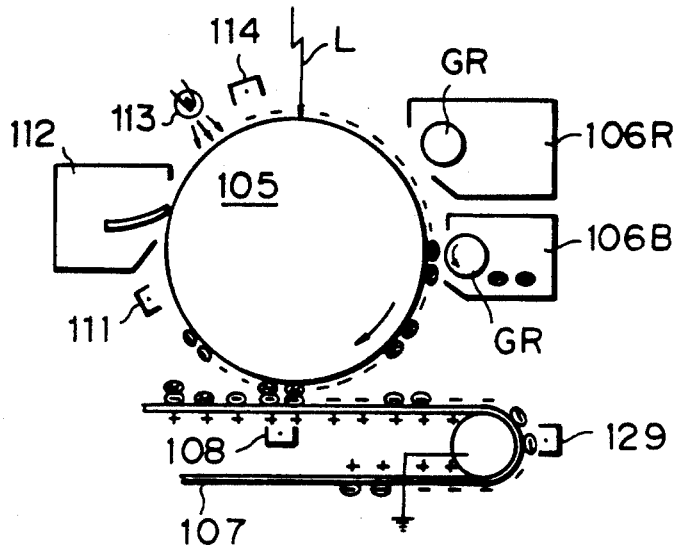
Figure 8:
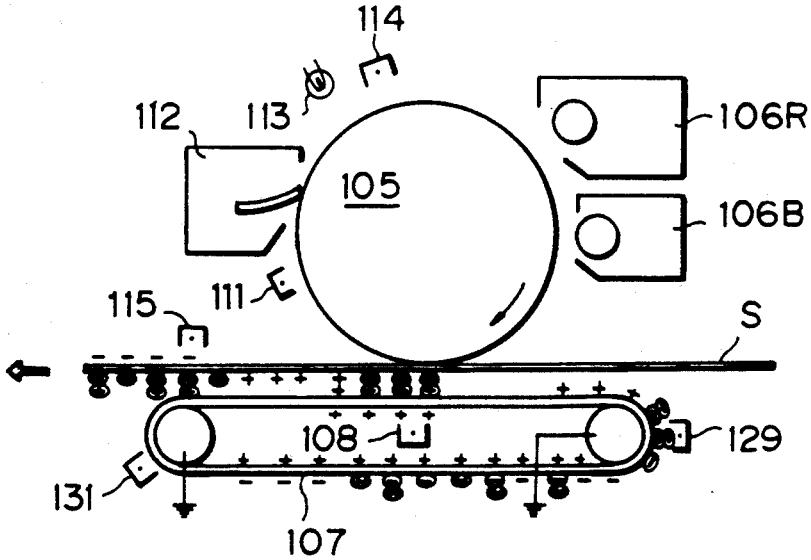

When a black-and-red color image is to be produced, for example, a red secondary toner image is transferred to the belt 107 by the procedure described with reference to FIG. 4, and then a latent image representative of a black image is formed on the drum 105. A black toner image produced by the developing unit 106B is transferred to the belt 107 over the red secondary toner image by the charger 108, as indicated by hatching in FIG. 7. While the image transfer voltage is sequentially increased from the first transfer of a secondary toner image to the second transfer, the charger 131 discharges the belt 107 and toner to preserve the image transfer efficiency. The black and red inverted images formed on the belt 107 are transferred to the back of a paper sheet S by the charger 108, as shown in FIG. 8. Then, the paper sheet S is separated from the belt 107 to be transported to the fixing means 117. In this procedure, the charger 129 is activated immediately before the re-transfer of the inverted secondary toner images to the paper sheet S, whereby the polarity of the secondary toner images and belt 107 is inverted immediately before the paper sheet S is superposed. When a full-color image is desired, the developing means 106 will be replaced with the developing means 106' shown in FIG. 2.

Advantage of Method 4

A one-sided color image can be produced by a simple construction.

METHOD 5

This method forms a monochromatic image on the surface of a sheet and a two-color or full-color image on the back. Specifically, a color secondary toner image is formed on the belt 107 by the process stated in Method 4, and then a monochromatic primary toner image is formed on the drum 105. Thereafter, the monochromatic image and the color image are respectively transferred to the surface and the back of a paper sheet by the process of Method 3.

EXAMPLE 2

This example is characterized by the processes shown in FIGS. 9 to 13. Methods 6 to 11 are available with this example, as follows.

METHOD 6

Mode

This method forms a monochromatic image on the surface of a paper sheet and is effected in a monochromatic one-side mode. This mode is selected in the same manner as in Method 1. The charger 131 does not function, while the charger 108 is switchable in polarity. The charger 129 functions to discharge the belt 107 and is applied with AC superposed on DC.

Process

The charger 108 is conditioned to effect positive corona discharge. A monochromatic image is formed on the surface of a paper sheet by a negatively charged toner and on the basis of the process of Method 1.

METHOD 7 (SEE FIGS. 9 AND 10)

This method forms a monochromatic image on the back of a paper sheet and is effected in a monochromatic one-side mode. This mode is selected in the same manner as in Method 1. The charger 129 is applied with AC which is superposed on negative DC so as to function to discharge the belt 107. The charger 115 serves to separate a paper sheet and applied with AC which is superposed on positive DC.

Process

Figure 9:
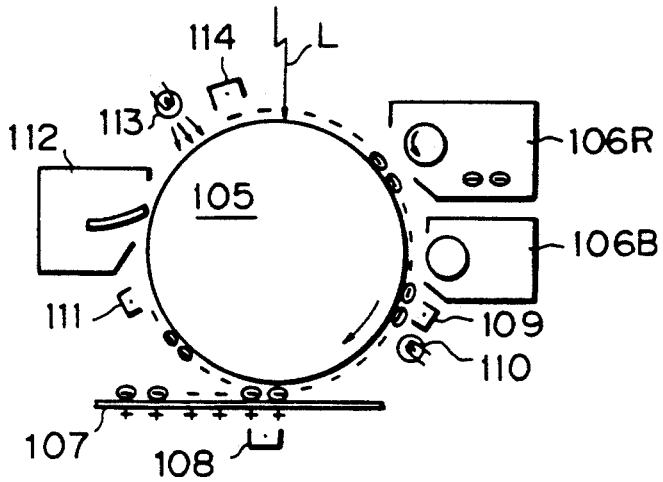
Figure 10:
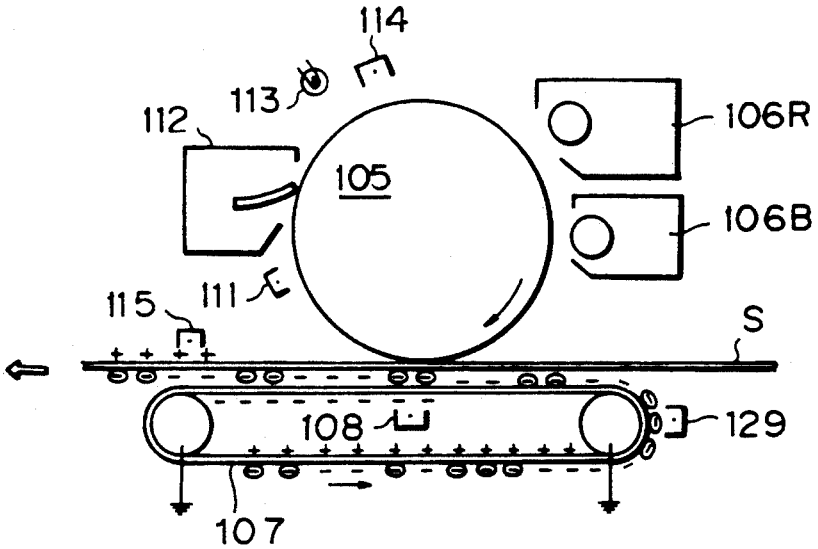

As shown in FIG. 9, a primary toner image is formed on the drum 105 by a negatively charged toner and on the basis of Method 2. The primary toner image is transferred to the surface of the belt 107 as an inverted secondary toner image by the positive corona discharge of the charger 108 which is opposite in polarity to the toner. Therefore, the charger 108 operates as intermediate image transferring means in this example also. As shown in FIG. 10, after the secondary toner image formed by the negative toner has moved away from the cleaner 116 which is spaced apart from the belt 107, it is transferred to the back of a paper sheet S by the negative corona discharge of the charger 108 which is the same in polarity as the toner. Hence, the charger 108 functions as secondary toner image transferring means also. The paper sheet S carrying the toner image thereon is separated from the belt 107 by the charger 115 and then driven toward the fixing means 117.

METHOD 8 (SEE FIGS. 9, 10 AND 11)

Mode

This method forms monochromatic images on opposite sides of a paper sheet at the same time and is effected in a monochromatic two-side mode. This mode is selected in the same manner as in Method 1. The charger 109 inverts the polarity of a negatively charged toner on the drum 105 to positive polarity. The discharger 110 discharges the toner and drum 105 in order to promote smooth image transfer which will follow.

Process

Figure 11:
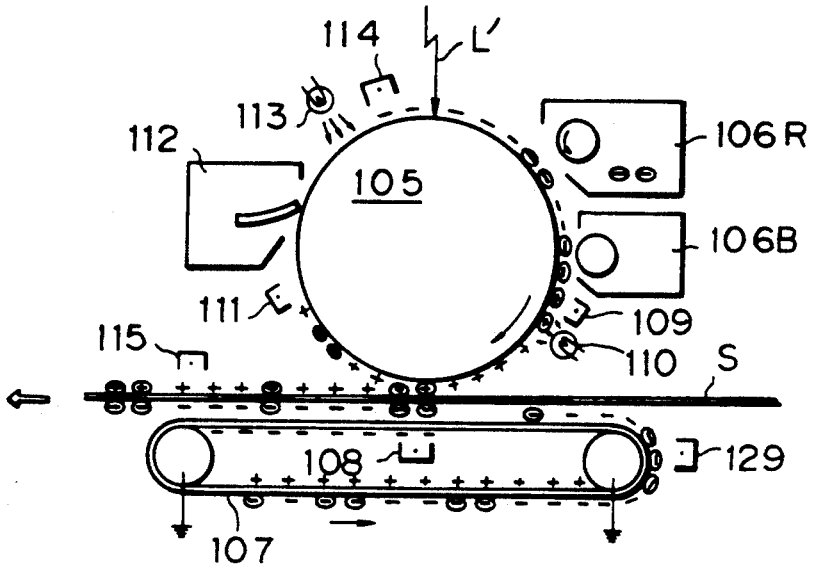

First, a negative secondary toner image is formed on the belt 107 by the developing unit 106R and by Method 2 (see FIG. 9). Then, a negative inverted latent image is formed on the drum 105 by an imagewise beam L', as shown in FIG. 11. This latent image is developed by the developing unit 106R to form a negative primary toner image. The negative primary toner image is inverted in polarity by the pretransfer charger 109 to produce a positive primary toner image. The adhesion acting between the primary toner image and the drum 105 is weakened by the discharger 110 to promote smooth image transfer. The positive primary toner image on the drum 105 and the negative secondary toner image on the belt 107 are respectively transferred to the surface and the back of a paper sheet S by the negative corona discharge of the charger 108, as shown in FIG. 11. In this example, therefore, the charger 108 serves three different functions at the same time, i.e., primary toner image transferring means, intermediate transferring means, and secondary toner image transferring means. It is to be noted that the corona discharge of the charger 108 is switched to one polarity when the secondary toner image is formed by Method 7 and to the other polarity when images are formed on opposite sides by Method 8.

METHOD 9 (SEE FIGS. 9 AND 12)

Mode

This method forms a black-and-red image or a full-color image on the back of a paper sheet and is effected in a color one-side mode. This mode is selected in the same manner as in Method 1. The charger 108 is applied with a variable transfer voltage. The chargers 109, 129 and 131 do not function.

Process

Figure 12:
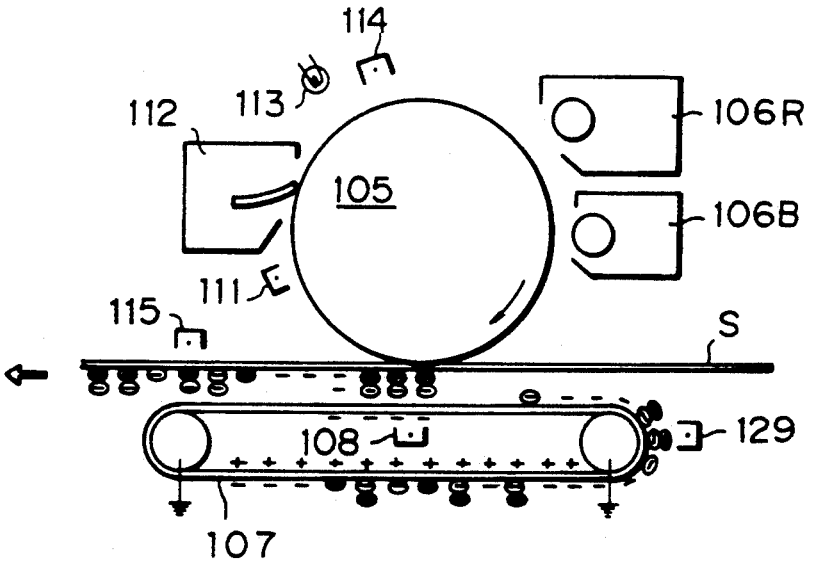

A negatively charged red secondary toner image is transferred to the belt 107 by the procedure described with reference to FIG. 9 in Method 9, whereafter a latent image for a black image is formed on the drum 105. The latent image is developed by the developing unit 106B to produce a black primary toner image (negative). The black primary toner image is transferred to the belt 107 over the red secondary toner image, as indicated by hatching in FIG. 7. While a higher voltage is used in the second transfer of the secondary toner image than in the first transfer, the charger 129 discharges the belt 107 and toner to maintain the transfer efficiency. The black-and-red inverted secondary toner image formed on the belt 107 is transferred to the back of a paper sheet S by the charger 108, as shown in FIG. 12. Thereupon, the paper sheet S is separated from the belt 107 by the charger 115 and driven toward the fixing means 117. The developing means 106 may be replaced with the developing means 106' shown in FIG. 2 so as to produce a one-side full color image.

METHOD 10

This method produces a monochromatic image and a two-color or a full-color image on the surface and the back of a paper sheet, respectively. Specifically, after a color secondary toner image has been formed on the belt 107 by the process stated in Method 9, a monochromatic primary toner image is formed on the drum 105. The monochromatic image and the color image are respectively transferred to the surface and the back of a paper sheet S by the process of Method 8.

METHOD 11 (SEE FIG. 13)

Figure 13:
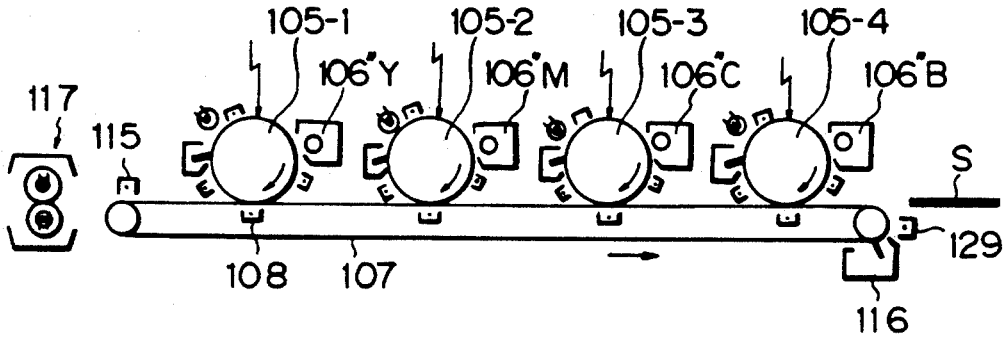

This method forms full-color or two-color images on opposite sides of a paper sheet as desired and is effected in a two-side color mode. As shown in FIG. 13, four photoconductive drums 105-1, 105-2, 105-3 and 105-4 are arranged along the belt 107. A yellow developing unit 106"Y, a magenta developing unit 106"M, a cyan developing unit 106"C and a black developing unit 106"B are associated with the drums 105-1, 105-2, 105-3 and 105-4, respectively.

Process

The developing units 106"Y, 106"M, 106"C and 106"B form a full-color secondary toner image on the belt 107 by the process of Method 9. While this secondary toner image is transferred to the back of a paper sheet S, monochromatic color primary toner images formed on the individual drums are sequentially transferred to the paper sheet S as the latter moves. As a result, full-color images are produced on opposite sides of the paper sheet S. Of course, two-color development or similar development may be executed by selectively using the developing units.

EXAMPLE 3

Figure 14:
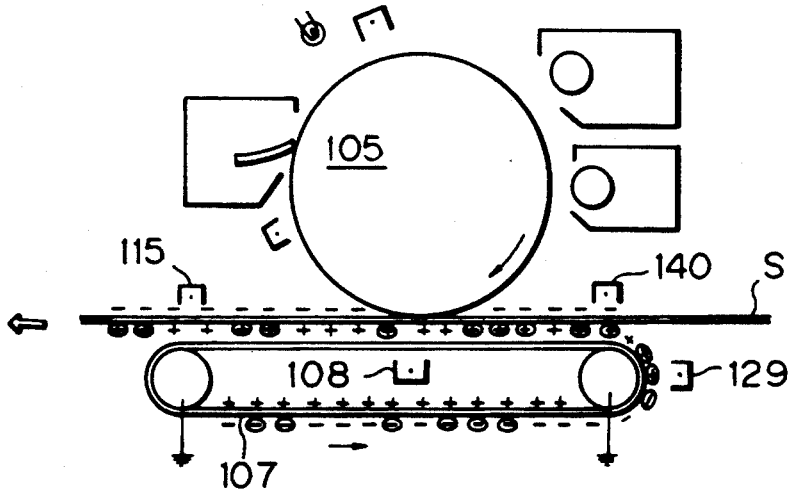
Figure 15:
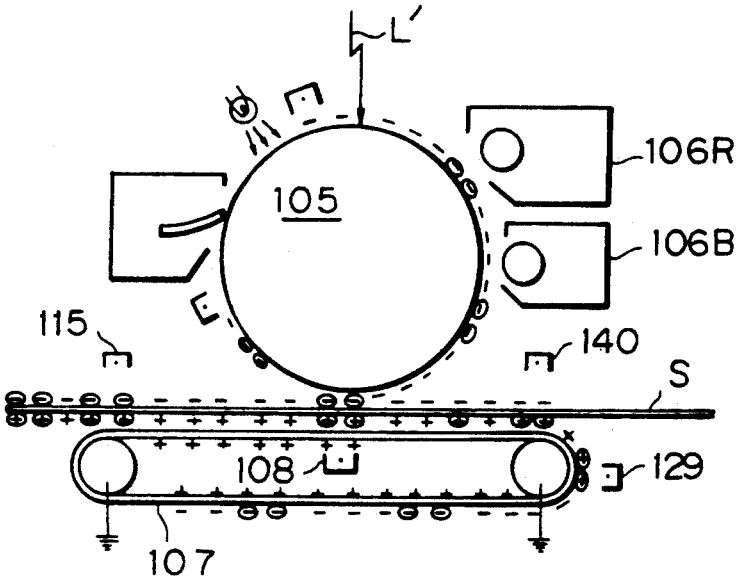
Figure 16:
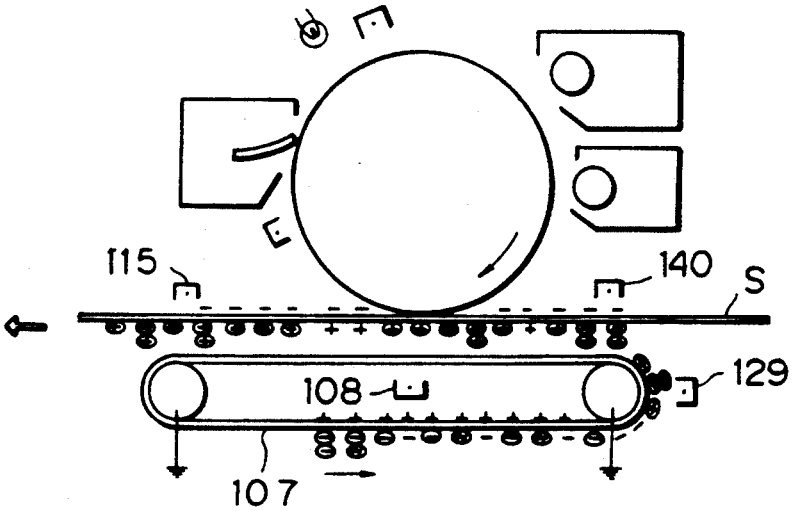

This example is characterized by the processes shown in FIGS. 14 to 16. As shown in FIG. 14, for example, a second charger 140 is located above the right end of the belt 107 to serve as secondary toner image transferring means. Negative DC is applied to the second charger 140. The charger 129 is applied with DC which is superposed on AC and functions to invert the polarity of a negative secondary toner image. With such a construction, it is possible to form images by any of Methods 12 to 15 which will be described.

METHOD 12

Mode

This method forms a monochromatic image on the surface of a paper sheet S and is effected in a monochromatic one-side mode. This mode is selected in the same manner as in Method 1. The chargers 129 and 140 do not function. The charger 115 plays the role of a charger for separating a paper sheet S.

Process

The same process as in Method 1 is used.

METHOD 13 (SEE FIGS. 9, 13 AND 14)

Mode

This method forms a monochromatic image on the back of a paper sheet S and is effected in a monochromatic one-side mode. This method is selected in the same manner as in Method 1. The charger 129 inverts the polarity of a secondary toner image, while the charger 140 transfers the secondary toner image to a paper sheet S.

Process

A negative secondary toner image is formed on the belt 107 by the process described with reference to FIG. 9 in Method 7. The secondary toner image is inverted in polarity by the charger 129 to become a positive secondary toner image. Then, as shown in FIG. 14, the secondary toner image is transferred to a paper sheet S by a negative charge which is generated by the corona discharge of the second charger 140. The image transfer may be backed up by the positive corona discharge of the charger 108, if desired.

METHOD 14 (SEE FIGS. 9, 14 AND 15)

Mode

This method forms a monochromatic image on both sides of a paper sheet at the same time and is effected in a monochromatic two-side mode. This method is selected in the same manner as in Method 1. Voltages are applied to the chargers as in Method 13.

Process

A negative secondary toner image is formed on the belt 107 by the process of Method 13. The secondary toner image is inverted in polarity by the charger 129 to produce a positive secondary toner image, as shown in FIG. 15. On the other hand, a negative primary toner image is formed on the drum 105 by the process of Method 12. Then, as shown in FIG. 15, the secondary toner image on the belt 107 is transferred to the surface of a paper sheet S by the second charger 140 while the primary toner image is transferred to the back by the charger 108.

METHOD 15 (SEE FIG. 16)

Mode

This method forms a two-color or a full-color image on the back of a paper sheet S and is effected in a one-side color mode. This mode is selected in the same manner as in Method 1. The charger 108 is provided with a function of changing the transfer voltage.

Process

A two-color secondary toner image is formed on the belt 107 by the process described with reference to FIG. 7 in Method 9. The secondary toner image is inverted in polarity by the charger 129 to produce a positive secondary toner image, as shown in FIG. 16. The positive secondary toner image is transferred to the back of a paper sheet S.

METHOD 16

This method forms a monochromatic image and a two-color or a full-color image on the surface and the back of a paper sheet S, respectively. Specifically, a color secondary toner image is formed on the belt 107 by the process of Method 15, while a monochromatic primary toner image is formed on the drum by the process of Method 12. The monochromatic image and the two-color image are respectively transferred to the surface and the back of a paper sheet by the process of Method 14. To produce a full-color image, the developing means 106' shown in FIG. 2 is used.

EXAMPLE 4

Figure 17:
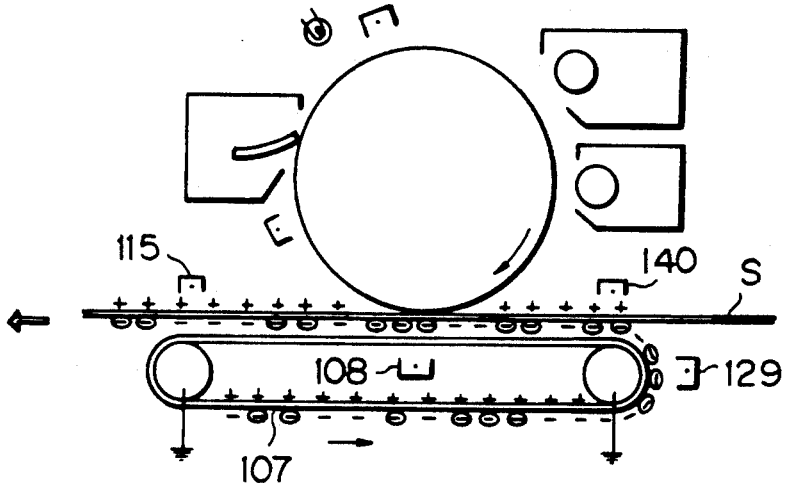
Figure 18:
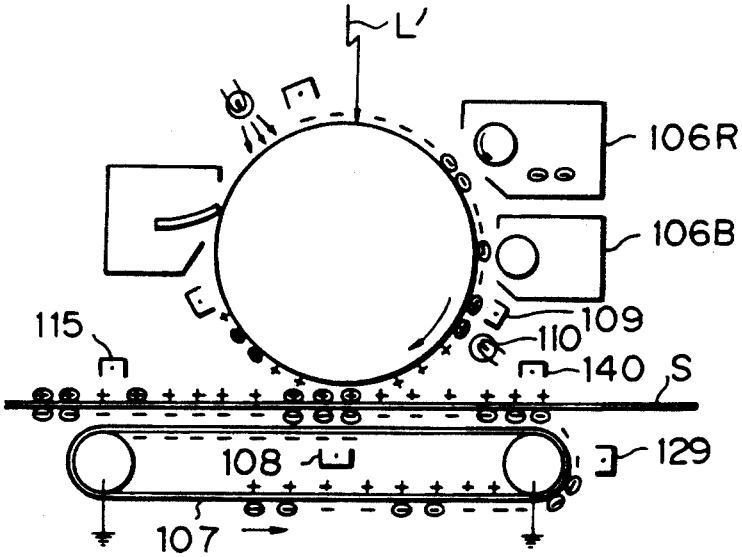
Figure 19:
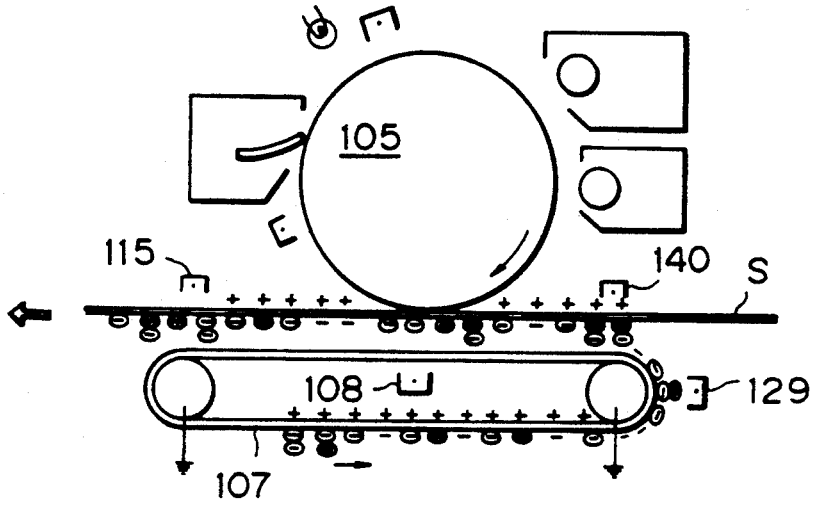

This example is characterized by the processes shown in FIGS. 17 to 19. In this example, the charger 129 serves a discharging function and does not have a polarity inverting function. The pretransfer charger 109 inverts the polarity of a primary toner image, while the discharger 110 functions to promote easy image transfer. The charger 140 is applied with positive DC for transferring a secondary toner image. The charger 115 is applied with positive DC which is superposed on AC and separates a paper sheet S. With such a construction, it is possible to form images by any of Methods 17 to 21 as will be described.

METHOD 17

Mode

This method forms a monochromatic image on the surface of a paper sheet S and is effected in a monochromatic one-side mode. This mode is selected in the same manner as in Method 1.

Process

The same process as in Method 1 is used.

METHOD 18 (SEE FIG. 17)

Mode

This method forms a monochromatic image on the back of a paper sheet and is effected in a monochromatic one-side mode. This mode is selected in the same manmer as in Method 1.

Process

A negative secondary toner image is formed on the belt 107 by the process described with reference to FIG. 9 in Method 7. The negative secondary toner image is discharged by the charger 129 to promote easy transfer and then transferred to the back of a paper sheet S by the second charger 140, as shown in FIG. 17. The charger 108 does not function.

METHOD 19 (SEE FIG. 18)

Mode

This method forms a monochromatic image on both sides of a paper sheet at the same time and is effected in a monochromatic two-side mode. This mode is selected in the same manner as in Method 1.

Process

A negative secondary toner image is formed on the belt 107 by the process of Method 18, while a negative primary toner image is formed on the drum 105 by the process of Method 17. As shown in FIG. 18, the negative primary toner image is inverted in polarity by the pretransfer charger 109 to produce a positive primary toner image. The charger 110 discharges the positive primary toner image. Thereupon, the secondary toner image is transferred to the back of a paper sheet S by the second charger 140, whereafter the primary toner image on the drum 105 is transferred to the surface of the paper sheet S by the charger 108. The paper sheet S carrying the monochromatic images on opposite sides thereof is separated from the belt 107 by the charger 115 and then fed toward the fixing means. It is to be noted that the corona discharge of the charger 108 differs in polarity from the formation of the secondary toner image of Method 18 to the two-side transfer of Method 19.

METHOD 20 (SEE FIG. 19)

Mode

This method forms a two-color or a full-color image on the back of a paper sheet S and is effected in a one-side color mode. This mode is selected in the same manner as in Method 1. The charger 108 is provided with a function of changing the transfer voltage.

Process

A two-color secondary toner image is formed on the belt 107 by the process described with reference to FIG. 7 in Method 9. The secondary toner image is discharged by the charger 129 and then transferred to the back of a paper sheet S by the second charger 140, as shown in FIG. 19. To produce a full-color image, the developing means 106' shown in FIG. 2 is used.

METHOD 21

This method produces a monochromatic image and a two-color or a full-color image on the surface and the back of a paper sheet S, respectively. A two-color secondary toner image is formed on the belt 107 by the process of Method 20, while a monochromatic primary toner image is formed on the drum 105 by the process of Method 7. The monochromatic image and the two-color image are respectively transferred to the surface and the back of a paper sheet S by the process of Method 19. To produce a full-color image, the developing means 106' shown in FIG. 2 is used.

EXAMPLE 5

Figure 20:
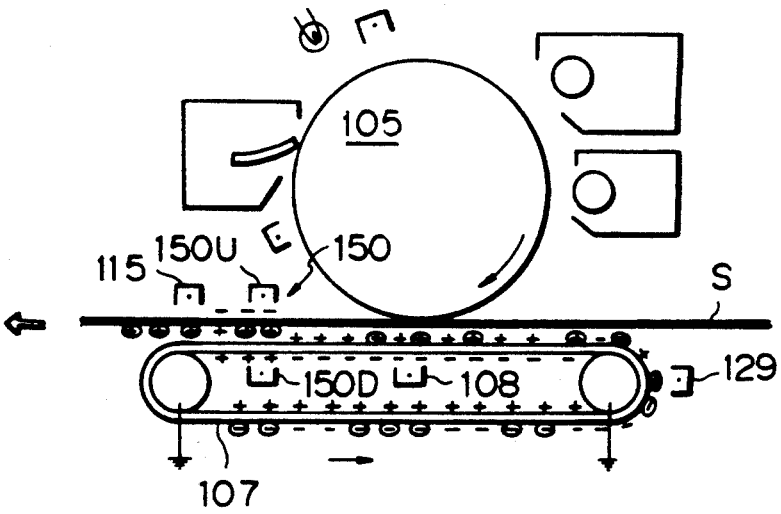
Figure 21:
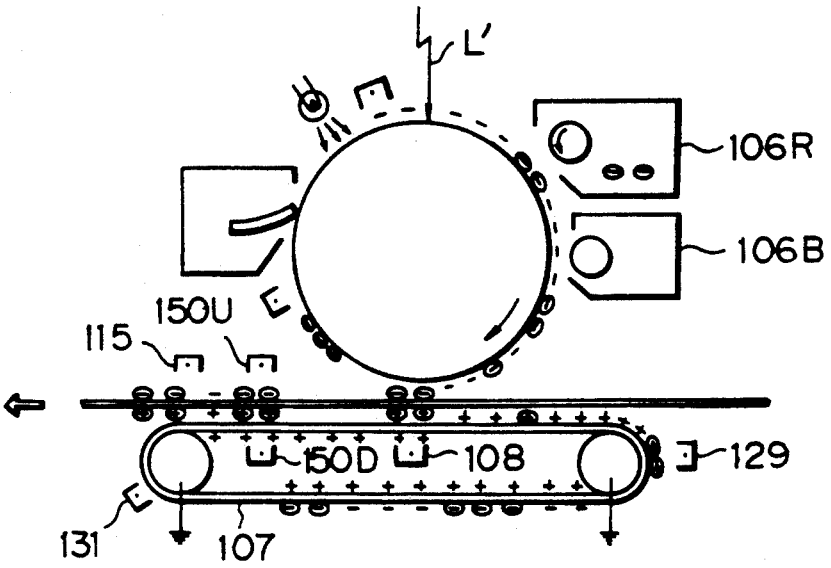
Figure 22:
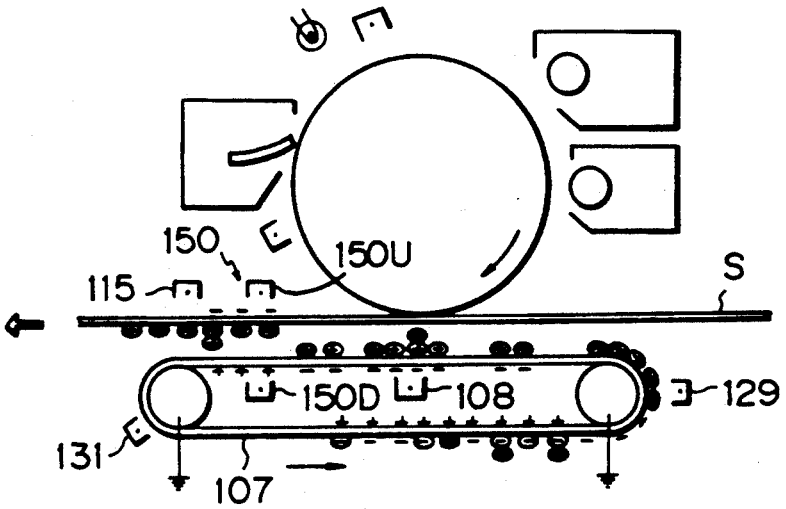

This example is characterized by the processes shown in FIGS. 20 to 22. In this example, the charger 129 is applied with positive DC which is superposed on AC so as to invert polarity and not to discharge. The pretransfer charger 109 and discharger 110 do not function and, therefore, they are not shown in the figures. The charger 115 is applied with positive DC which is superposed on AC and functions to separate a paper sheet. As shown in FIG. 20, a pair of third chargers 150, i.e., an upper charger 150U and a lower charger 150D are located to face each other with the intermediary of the belt 107 and paper transport path at a position immediately upstream of the charger 115 with respect to the direction of paper transport. With such a construction, it is possible to form images by any of Methods 22 to 26 which will be described.

METHOD 22

Mode

This method forms a monochromatic image on the surface of a paper sheet S and is effected in a monochromatic one-side mode. This mode is selected in the same manner as in Method 1.

Process

The same process as in Method 1 is used.

METHOD 23 (SEE FIG. 20)

Mode

This method forms a monochromatic image on the back of a paper sheet S and is effected in a monochromatic one-side mode. This mode is selected in the same manner as in Method 1.

Process

A negative secondary toner image is formed on the belt 107 by the process described with reference to FIG. 9 in Method 7. The negative secondary toner image is inverted in polarity by the charger 129 and then transferred to the back of a paper sheet S by the third chargers 150. At this instant, a negative voltage and a positive voltage are applied to the upper and lower chargers 150U and 150D, respectively. The charger 108 does not function.

METHOD 24 (SEE FIG. 21)

Mode

This method forms a monochromatic image on both sides of a paper sheet S at the same time and is effected in a monochromatic two-side mode. This mode is selected in the same manner as in Method 1.

Process

A negative secondary toner image is formed on the belt 107 by the process of Method 23, while a negative primary toner image is formed on the drum 105 by the process of Method 22. As shown in FIG. 21, the negative secondary toner image is inverted in polarity by the charger 129 and then transferred to the back of a paper sheet. The negative primary toner image on the drum 105 is transferred to the surface of the paper sheet S by the charger 108 and, at the same time, the secondary toner image on the belt 107 is transferred to the back of the paper sheet S. The paper sheet S carrying a monochromatic image on both sides thereof is effected by the third chargers 150 insure the image transfer. Then, the paper sheet S is separated from the belt 107 to be fed toward the fixing means.

METHOD 25 (SEE FIG. 22)

Mode

This method forms a two-color or a full-color image on the back of a paper sheet S and is effected in a one-side color mode. This mode is selected in the same manner as in Method 1. The charger 108 does not function.

Process

A negative two-color secondary toner image is formed on the belt 107 by the process described with reference to FIG. 7 in Method 9. As shown in FIG. 22, the secondary toner image is inverted in polarity by the charger 129 and then transferred to the back of a paper sheet S by the third chargers 150. To produce a full-color image, the developing means 106' shown in FIG. 2 is used.

METHOD 26

This method produces a monochromatic color image and a two-color or a full-color image on the surface and the back of a paper sheet, respectively. Specifically, a two-color secondary toner image is formed on the belt 107 by the process of Method 25, while a monochromatic primary toner image is formed on the drum by the process of Method 22. The monochromatic image and the color image are respectively transferred to the surface and the back of a paper sheet S by the process of Method 24. To produce a full-color image, the developing means 106' shown in FIG. 2 is used.

EXAMPLE 6

Figure 23:
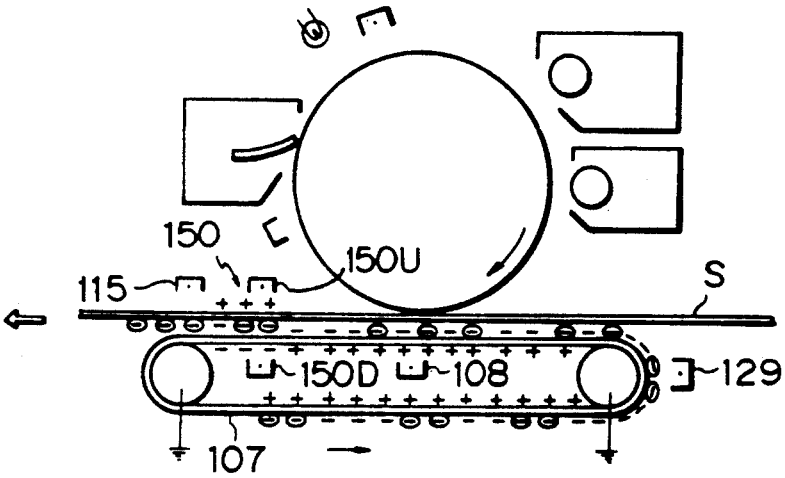
Figure 24:
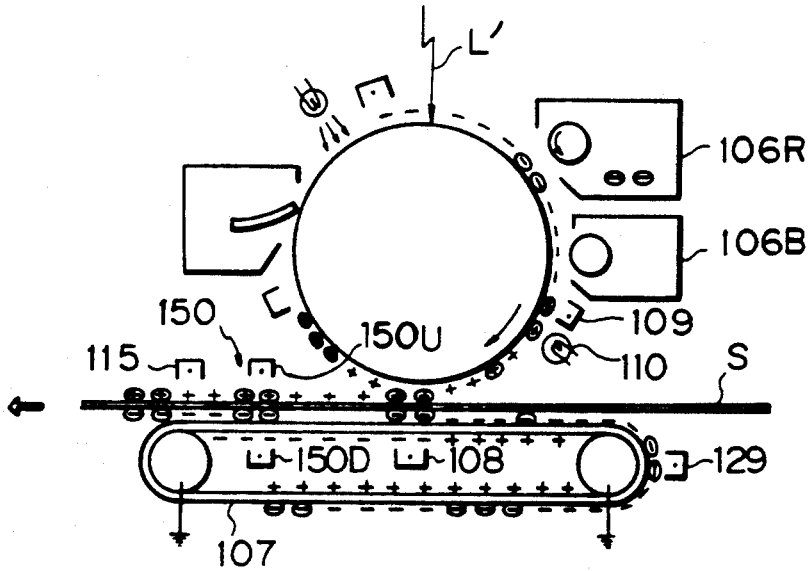
Figure 25:
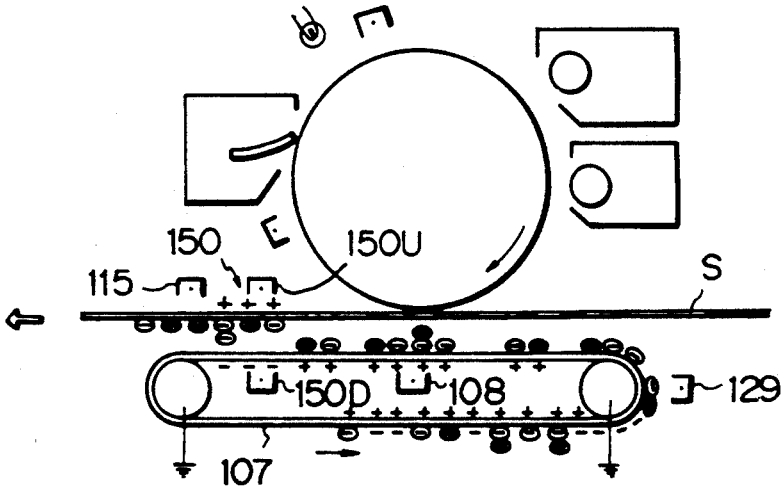

This example is characterized by the processes shown in FIGS. 23 to 25. In this particular example, the charger 129 serves a discharging function and does not invert polarity. The pretransfer charger 109 inverts the polarity of a primary toner image. The discharger 110 serves as a discharger for promoting easy image transfer. The charger 140 does not function and, therefore, it is not shown in the figures. The charger 115 is applied with positive DC which is superposed on AC and serves to separate a paper sheet S. With such a construction, it is possible to produce images by any of Methods 27 to 31 which will be described.

METHOD 27

Mode

This method produces a monochromatic image on the surface of a paper sheet and is effected in a monochromatic one-side mode. This mode is selected in the same manner as in Method 1.

Process

The same process as in Method 1 is used.

METHOD 28 (SEE FIG. 23)

Mode

This method forms a monochromatic image on the back of a paper sheet S and is effected in a monochromatic one-side mode. This mode is selected in the same manner as in Method 1.

Process

A negatively charged secondary toner image is formed on the belt 107 by the process described with reference to FIG. 9 in Method 7. The negative secondary toner image is discharged by the charger 129 for each transfer and then transferred to the back of a paper sheet S by the charger 108 and third chargers 150.

METHOD 29 (SEE FIG. 24)

This method forms a monochromatic image on both sides of a paper sheet S at the same time and is effected in a monochromatic two-side mode. This mode is selected in the same manner as in Method 1.

Process

A negatively charged secondary toner image is formed on the belt 107 by the process of Method 28 and is discharged by the charger 129, while a negative primary toner image is formed on the drum 105 by the process of Method 27. As shown in FIG. 24, the negative primary toner image is inverted in polarity by the pretransfer charger 109 to produce a positive primary toner image. The positive primary toner image is discharged by the discharger 110. The negative secondary toner image on the belt 107 is transferred to the back of a paper sheet S by the charger 108, and at the same time the positive primary toner image is transferred to the surface of the paper sheet S by the charger 108. The third chargers 150 further insure the image transfer to the paper sheet S carrying the monochromatic images on both sides thereof. The paper sheet S is separated from the belt 107 by the charger 115 and then driven toward the fixing means. It is to be noted that the corona discharge of the charger 108 is switched in polarity for the two-side image transfer of Method 29, compared to the formation of secondary toner image of Method 28.

METHOD 30 (SEE FIG. 25)

Mode

This method produces a two-color or a full-color image on the back of a paper sheet S and is effected in a one-side color mode. This mode is selected in the same manner as in Method 1. The charger 108 is provided with a function of changing the transfer voltage.

Process

A negative two-color secondary toner image is formed on the belt 107 by the process described with reference to FIG. 7 in Method 9. The secondary toner image is discharged by the charger 129 and then transferred to the back of a paper sheet S by the third chargers 150, as shown in FIG. 25. In this mode, the charger 108 does not function. To produce a full-color image, the developing means 106' shown in FIG. 2 is used.

METHOD 31

This method produces a monochromatic image and a two-color or a full-color image on the surface and the back of a paper sheet respectively. Specifically, a two-color secondary toner image is formed on the belt 107 by the process of Method 30, while a monochromatic primary toner image is formed on the drum by the process of Method 27. The monochromatic image and the two-color image are respectively transferred to the surface and the back of a paper sheet S by the process of Method 29. To produce a full-color image, the developing means 106' shown in FIG. 2 is used.

EXAMPLE 7

This example is applicable to a two-side copying sequence which is available with an electrophotographic apparatus, electrostatic recording apparatus, printer or similar recording apparatus of the type having a single image forming body. Specifically, this example transfers a first toner image which is to be produced on the back of a paper sheet from the image forming body to an intermediate transferring body, lays a paper sheet on the first toner image, and then transfers a second toner image which is to be produced on the surface of the paper sheet to the surface of the paper sheet, thereby producing a two-sided copy. Such a procedure will be described with reference to FIGS. 26 to 33.

Figure 26:
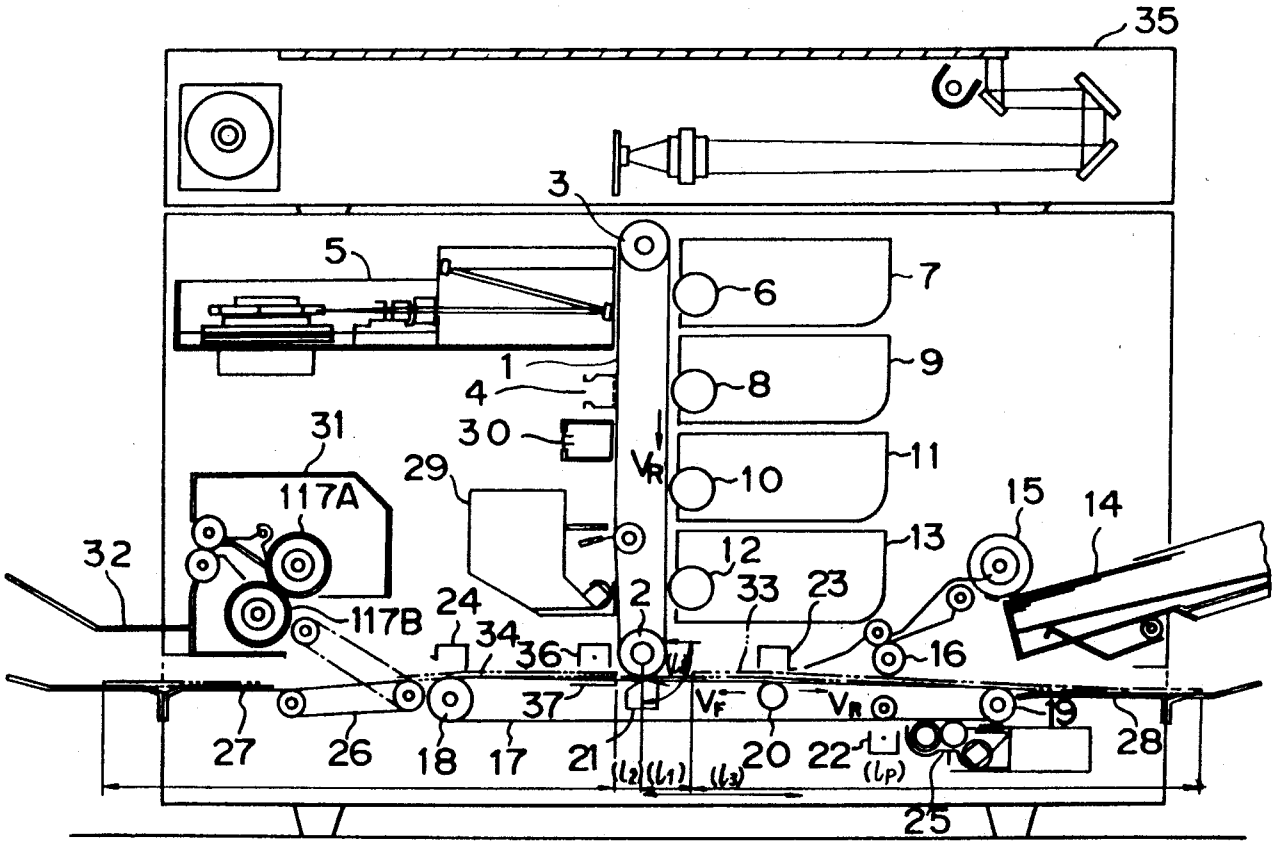

FIG. 26 schematically shows a color recording apparatus with which this example is practicable. As shown, the apparatus includes a photoconductive element in the form of a belt 1. The belt is rotatably supported at one end by a drive roller 2 and at the other end by a driven roller 3. A charger 4 charges the belt 1. An optical writing unit 5 forms electrostatic latent images individually associated with different colors on the belt 1. Developing units 7, 9, 11 and 13 develop the latent images in colors assigned thereto. Developing rollers 6, 8, 10 and 12 are incorporated in the developing units 7, 9, 11 and 13, respectively. The reference numerals 14, 33 and 34 designate paper sheets. A feed roller 15 feeds the paper sheets 14 one by one into the recording apparatus. Designated by the reference numeral 16 is a register roller. A transfer belt 17 serves as a paper support and transport body for transporting the paper sheet 14 to an image transfer station and a fixing station in sequence. The transfer belt 17 is rotatably supported at one end by a drive roller 18 and at the other end by a driven roller 19. A belt switching roller 20 moves the transfer belt 17 toward and away from the photoconductive belt 1. A transfer charger 21 transfers a developed image from photoconductive belt 1 to the paper sheet 14. A charger 22 discharges the transfer belt 17. A charger 23 electrostatically retains the paper sheet 14 on the transfer belt 17. A charger 24 separates the paper sheet from the transfer belt 17. A belt cleaner 25 removes paper dust, developer and so forth from the transfer belt 17. A transfer belt 26 changes over the direction in which a paper sheet undergone image transfer is to be transported. The reference numerals 27 and 28 designate a paper leading edge guide and a paper trailing edge guide, respectively. A belt cleaner 29 is associated with the photoconductive belt 1 for removing residual toner from the belt 1 after image transfer. A discharger 30 discharges the photoconductive belt 1.

Fixing means 31 fixes an image carried on a paper sheet and is essentially the same as the fixing means 117 of FIG. 1. A copy tray 32 is provided for stacking copies which have undergone the image fixing step. A color image reader 35 reads a color image printed on a document. The reference numerals 36 and 37 designate respectively a charger for inverting the polarity of a toner and a counterelectrode associated with the charger 36.

The operation of the recording apparatus having the above construction will be described with reference to FIGS. 27 to 33.

Figure 27:
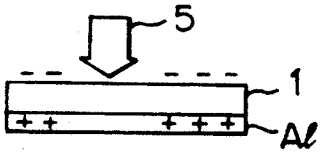
FIG. 27 is a schematic view showing charging and exposure of a photoconductive belt.
Figure 28:
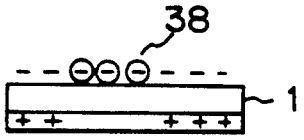
FIG. 28 is a schematic view showing a first toner image.
Figure 29:
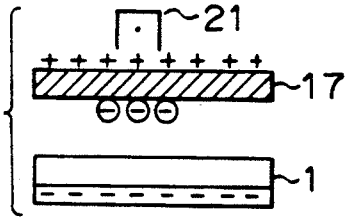
FIG. 29 is a schematic view showing the transfer of a toner image to an intermediate transfer body.
Figure 30:
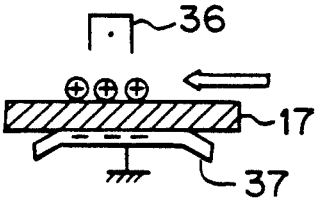
FIG. 30 is a schematic view demonstrating the inversion of toner polarity.
Figure 31:
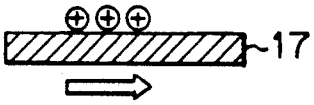
FIG. 31 is a schematic view showing the reversal of a transfer belt.

As shown in FIG. 27, the photoconductive belt 1 is negatively charged and then exposed to a non-inverted image by the optical writing unit 5. Subsequently, as shown in FIG. 28, the non-inverted latent image is developed (inverted) by a negatively charged toner to produce a first toner image 38. As shown in FIG. 29, a voltage of 5.5 kilovolts is applied to the transfer charger 21 to transfer the first toner image 38 to the transfer belt or intermediate transfer body 17. The belt is made of polyester and provided with a thickness of 75 microns. The polarity of the first toner image 38 on the belt 17 is changed from negative to positive by the charger 36 to which a voltage of +5.0 kilovolts is applied, as shown in FIG. 30. When the entire image is inverted (when the trailing edge of the picture is located at $l_2$), the movement of the transfer belt 17 reversed. After the transfer belt 17 has been returned until the leading edge of the image reaches a position $l_3$ and in such a manner as not to make contact with the photoconductive belt 1 (with the belt cleaner 25 being out of contact), the transfer belt 17 is again reversed, as shown in FIG. 31. Subsequenly, the paper sheet 14 is at a predetermined timing into register with the first toner image 38. A voltage of negative 5.5 kilovolts is applied to the charger 23 to cause the belt 17 to electrostatically retain the paper sheet 14 thereon. At the same time, the positively charged first toner image 38 is transferred from the belt 17 to the paper sheet 14.

Figure 33:
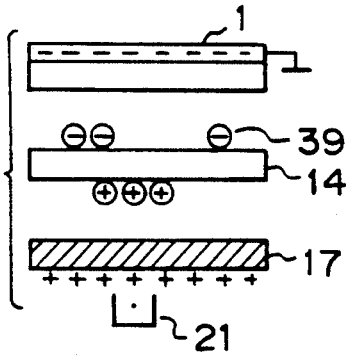
FIG. 33 is a view representative of the transfer of a toner image to the surface of a paper sheet.

As shown in FIG. 33, an inverted negatively charged toner image (second toner image) 39 is formed on the photoconductive belt 1 in the same manner as the first toner image. The paper sheet 14 is brought into register with the second toner image 39, while a voltage of 5.5 kilovolts is applied to the transfer charger 21 to transfer the toner image 39 to the surface of the paper sheet 14. The paper sheet 14 carrying the toner images 38 and 39 on opposite sides thereof is shifted from the belt 17 to the switching belt 26 which is rotating at the same speed as the belt 17. The belt 26 transports the paper sheet 14 to the fixing unit 31, so that the toner images 38 and 39 are fixed at the same time.

When the transfer belt 17 is to be reversed with the trailing edge of the image being located at the position $l_2$ and if the image has a size of A3, moving the belt 17 to bring the leading edge to a position $l_3$ is more preferable than reversing it in the time consumption aspect. Assuming that an image is to be produced in two or more colors, the switching belt 26 will transport the paper sheet 14 to the fixing means 31 after the completion of the second toner image 39 and transport it to the lead edge guide 27 before that.

Figure 32:
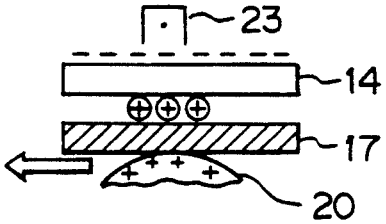
FIG. 32 is a view representative of the transfer of a toner image to the back of a paper sheet.

In FIG. 33, when the voltage of +5.5 kilovolts is to be applied to the transfer charger 21, it is possible to transfer the first toner image 38 at the same time without resorting to the operation of the charger 23 (zero voltage), as shown in FIG. 32.

As stated above, Example 7 transfers a first toner image to be produced on the back of a paper sheet to an intermediate transfer body (transfer belt 17). This reduces the distance which the first toner image travels and increases the copying speed, compared to the prior art apparatus which transfers a toner image to a paper sheet, fixes it on the paper sheet, transports the paper sheet, and then feeds the paper sheet again. Further, the procedure shown and described eliminates dislocation of images and, therefore, magnification errors. The short and substantially linear paper transport path is free from paper jams. In addition, even large paper sheets or small paper sheets such as postcards can be reproduced.

Examples 1 to 7 have been shown and described as transferring a primary toner image to the belt 107 every time it is formed by one kind of toner on the drum 105. With the present invention, however, it is also possible to form a primary toner image made up of toner images of different kinds on the drum 105 and the transfer the primary toner image to the paper sheet S or to the belt 107. A primary toner image made up of different kinds of toner images as mentioned above may be exemplified by:

(1) a composite image of a plurality of images developed by a black toner;

(2) a composite image of an image developed in one color and an image developed in another color;

(3) a multi-color image implemented by two or more desired colors; and (4) a full-color image.

To form any one of such images, it is necessary to form at least two different kinds of toner images on a photoconductive drum. This can be done by a procedure disclosed in "Fundamentals and Applications of Electrophotographic Technology" compiled by Committee of Electrophotographic Engineers and published by Corona, pp. 562–565, Jun. 16, 1988. A relevant part of this disclosure is as follows.

MULTI-COLOR PRINTING IMPLEMENTED BY DIGITAL SYSTEM

Single function, single transfer procedure is under study as an approach for digital multi-color printing. By single function, single transfer procedure, toner images of multiple colors are formed on a photoconductive element by superposing development, and a color image is produced by a single transfer.

Optical printer is generally designed with importance being attached to characters and other fine lines and, therefore, often uses negative-to-positive inversion for development which is excellent in the reproducibility of fine lines. A reference will be made to FIG. 45 for describing a process for forming a black and-red image by negative-to-positive inversion.

Figures 45A, 45B, 45C:
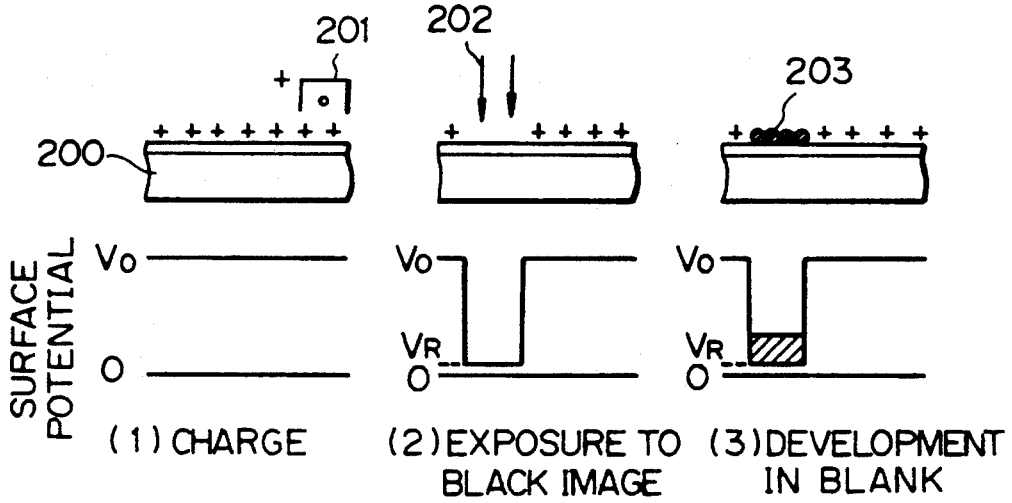
FIGS. 45*a*–45*f* is a schematic view showing a process for forming a black-and-red image.
Figures 45D, 45E, 45F:
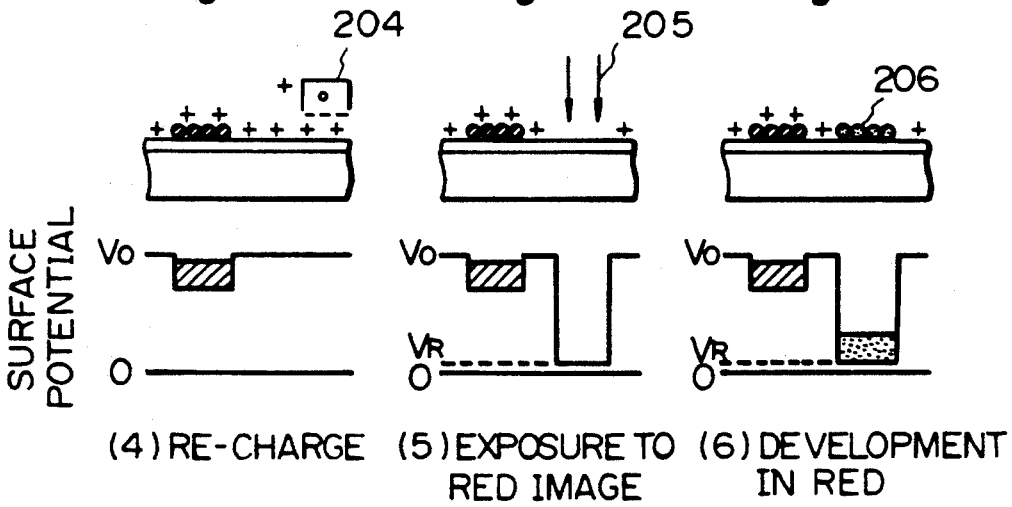

In FIG. 45, there are shown photoconductive element 200, corona charger 201, a black signal light 202, black toner 203, scorotron charger 204, red signal light 205, and red toner 206.

(1) Charging: Photoconductive element is positive charged to surface potential $V_0$ by corona discharge.

(2) Exposure to black image: Photoconductive element is exposed to black negative signal light. Surface potential of exposed portions representative of lines is attenuated to become residual potential VR of the photoconductive element.

(3) Development in black: The residual image is developed by positively charged black toner and by inversion so as to produce a black toner image. At this instant, surface potential of the portions developed by black toner is increased by the potential of black toner and does not coincide with the initial voltage $V_0$ of the photoconductive element. Specifically, the portions where black toner is deposited still has an ability to deposit toner. Therefore, should development by red toner be effected after the development by black toner, red toner would be deposited on black toner. To eliminate this occurrence, the surface potential of the portions where black toner is deposited has to be returned to the initial voltage $V_0$ before the formation of a red toner image.

(4) Re-charge: The photoconductive element is charged again by the scorotron charger to deposit the same surface potential as the non-developed portions on the portions where black toner is deposited. At this time, the toner layer and photoconductive layer in the portions where black toner is deposited are charged in inverse proportion to the individual electrostatic capacities.

(5) Exposure to red image: Exposure to red negative signal light is effected.

(6) Development in red: Development by red toner is effected.

Subsequently, the two toner images of different colors are transferred to a paper sheet at the same time by corona discharge, and then fixed by heat to produce a two-color print.

While the above description has concentrated on a two-color image, a three-color image is achievable by using a third toner and repeating the steps (4) to (6). Further, use of toners C, M and Y is successful in producing a full-color image. To reproduce a full-color image, a latent image has to be formed by illuminating from the above of a toner image. A prerequisite is, therefore, that a photoconductive element having a photoconductive layer whose electrostatic capacity is smaller than that of the toner layer be selected to insure sufficient charging as executed in the re-charging step (4).

To practice the present invention with the above-described process, use is made of the side-free recording apparatus shown in FIG. 1 with or without the developing means replaced with the developing means 106', or a side-free recording apparatus shown in FIG. 26. Then, the main charger 114 bifunctions as the corona charger 101 and scrorotron charger 104.

Assume that the present invention is practiced with a system which uses a single scanning beam and exposes the drum 105 to the single beam carrying one image information, develops the resulting latent image to produce a toner image, exposes the drum 105 to the scanning beam carrying another image information, and develops the resulting latent image to produce a toner image over the previous toner image. Then, the apparatus is provided with means for moving the belt 107 toward and away from the drum 105 in order to prevent the previous toner image formed on the drum 105 from being disturbed.

For the same reason, the cleaner 112 is movable toward and away from the drum 105. The developing means 106 uses a so-called jumping development system which spaces a photoconductive drum and a developing sleeve by 0.1 millimeter to 0.2 millimeter away from each other to avoid disturbance to an image and causes a toner to jump under the application of a predetermined bias voltage for development. Further, the present invention is practicable with a system wherein the drum 105 is illuminated by a plurality of beams representative of image data each being associated with a different color or of different image data at the same time, the resulting latent images are developed by independent developing sleeves at the same time to produce a primary toner image which is composed of different kinds of toner images, and then the primary toner image is transferred at a time. In such a case, the means for moving the intermediate transfer body as stated above is not necessary and, of course, the jumping development is not essential.

Examples will be described hereinafter. In the examples, the primary toner image is assumed to be a black-and-red toner image. A full-color image, multi-color image and monochromatic image which will not be described can be implemented by repeating the exposure and development a necessary number of times to form a primary toner image. The modes for practicing associated methods are switched over by the manipulation of button switches which are provided on the operation board and are executed by control means which uses a CPU. A method of forming an image on the surface of a paper sheet, method of forming an image on the back of a paper sheet, and method of forming on both sides of a paper sheet which are particular to each example will be described.

EXAMPLE 8

This example is a modification to Example 1 and, therefore, essentially the same as the latter concerning the general procedure for producing a copy. The difference is that in this example the primary toner image formed on the drum 105 is composed of a plurality of different toner images. Hence, a process for forming such a primary toner image is also different.

METHOD 32 (SEE FIGS. 36 AND 37)

This method forms an image on the surface of a paper sheet S in correspondence with Method 1 and is effected in a composite one-side mode. Concerning the chargers and various voltages, this method is the same as Method 1.

Process

Figure 36:
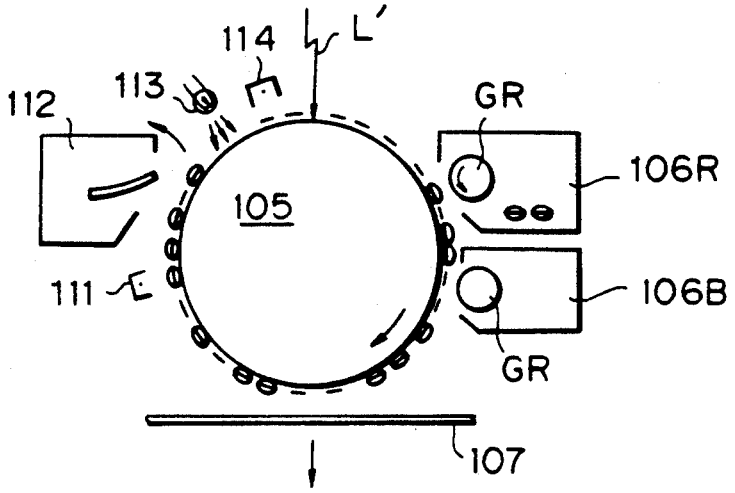
FIGS. 36 to 44 are schematic views showing different manners of image formation.
Figure 37:
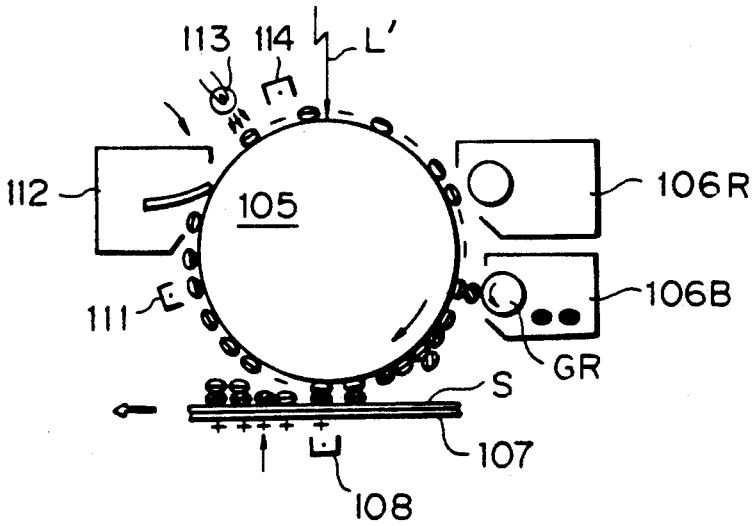

As shown in FIG. 36, a primary toner image is formed on the drum 105 with the belt 107 and cleaner 112 being retracted away from the drum 105 as indicated by arrows in the figure. First, while the drum 105 is rotated for the first time, the scanning beam L' from the optical writing means forms a latent image for a red image on the drum 105, and the developing unit 106R develops the latent image. During the second rotation of the drum 105, the scanning beam L' forms a latent image for a black image on the drum 105, and the developing unit 106B develops it. Assume that the scanning is controlled to write inverted latent images so that a non-inverted image may be reproduced on a paper sheet. As a result, a primary toner image is formed on the drum 105 and composed of an inverted red toner image and an inverted black toner image. In FIG. 37, signs with circles are representative of the red toner image, while signs with circles and hatching are representative of the black toner image.

After the first primary image has been formed on the drum 105, the belt 107 is brought into contact with the drum 105, as shown in FIG. 37. The cleaner 112 is also caused into contact with the drum 105 at a predetermined timing. In this condition, the primary toner image is transferred to a paper sheet S being transported by the belt 107. The image transfer is effected by positive corona charge which is opposite in polarity to the toners of the primary toner image.

METHOD 33 (SEE FIG. 38)

This method corresponds to Method 2 and forms an image on the back of a paper sheet and practiced in a composite one-side mode. This method is the same as Method 2 concerning the charges and various voltages.

Process

A primary toner image formed on the drum 105 is transferred to the belt 107 and then transferred to a paper sheet. In this process, therefore, the scanning beam L' is controlled to write a non-inverted latent image on the drum 105 so that a non-inverted image may be reproduced on a paper sheet.

Figure 38:
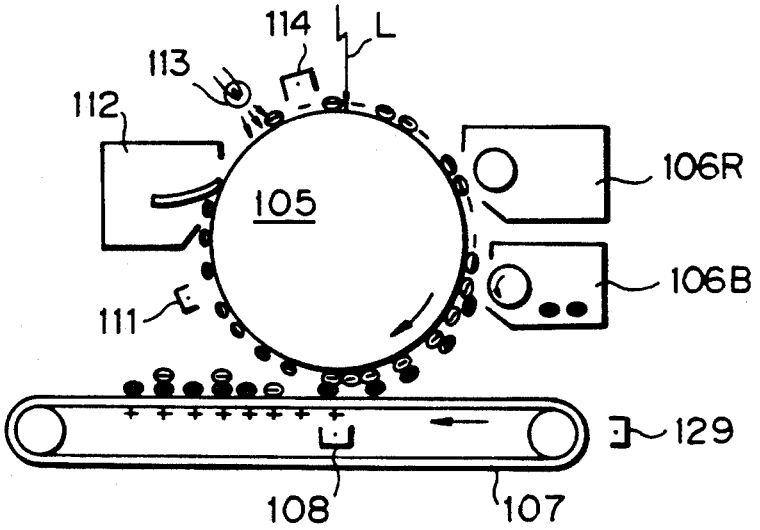
Figure 39:
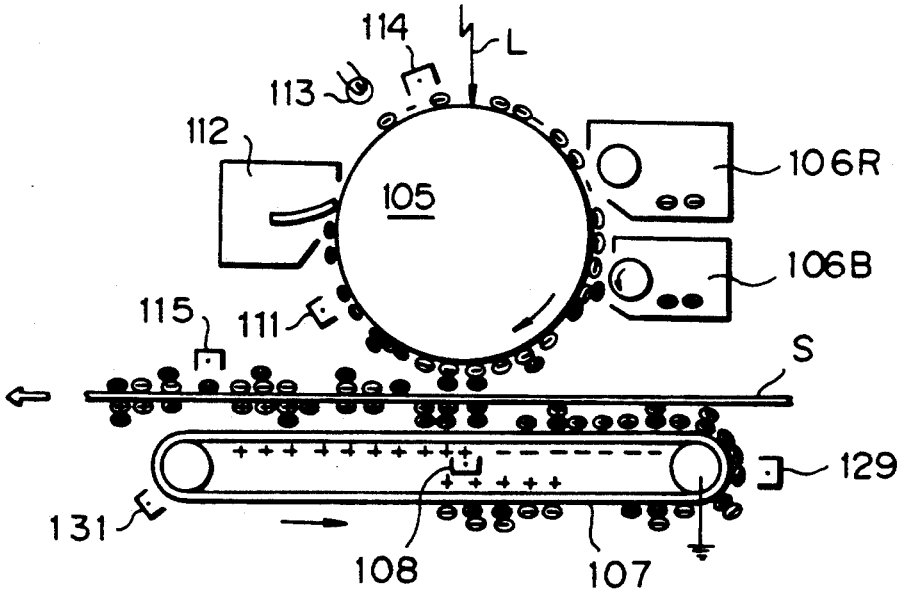
Figure 40:
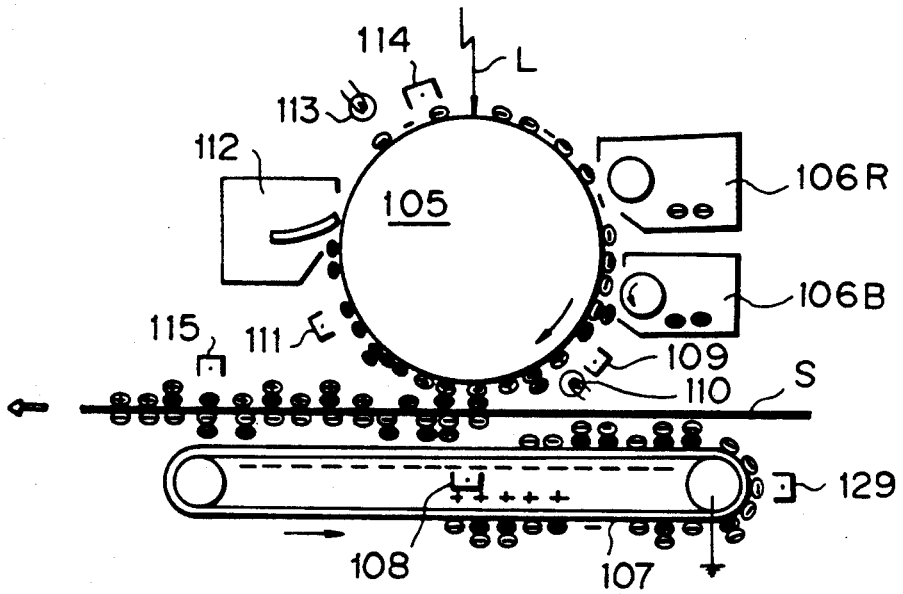

As shown in FIG. 38, a primary toner image formed on the drum 105 is transferred to the surface of the belt 107 as an inverted secondary toner image by the positive corona discharge of the charger 108 which is opposite in polarity to the toners. The secondary toner image is discharged by the charger 131, inverted in polarity by the charger 129, and then transferred to the back of a paper sheet S by the positive corona discharge of the charger 108 which is the same as the toner.

METHOD 34 (SEE FIGS. 38 AND 39)

Corresponding to Method 3, this method forms images on both sides of a paper sheet at the same time and is practiced in a composite two-side mode Process A negative toner image is formed on the belt 107 in the same manner as in Method 34 (see FIG. 38). This secondary toner image is turned to positive polarity as in Method 33. On the other hand, a negative primary toner image is formed on the drum 105 by the process of Method 32. While a paper sheet S is transported by the belt 107, the primary and secondary toner images are respectively transferred to the surface and the back of the paper sheet S by the positive corona discharge of the charger 108. Then, the paper sheet is driven toward the fixing means 117.

EXAMPLE 9

This example is a modification to Example 2 and, therefore, similar to the latter except that in this example the primary toner image is composed of a red and a black toner image and, therefore, it is formed by a different process. An image to be reproduced on the surface of a paper sheet S is formed by Method 32, while an image to be produced on the back is formed by Method 33.

METHOD 35

Corresponding to Method 8, this method forms images on both sides of a paper sheet S at the same time and is effected in a composite two-side mode. The charger 108 is switched to positive polarity when a secondary toner image is to be formed and to negative polarity in the event of image transfer to both sides of a paper sheet S.

Process

A negative secondary toner image is formed on the belt 107 by Method 33, while a negative primary toner image is formed on the drum 105 by Method 32. The polarity of the negative primary toner image is changed to positive by the pretransfer charger 109. The adhesion acting between the primary toner image and the drum 105 is weakened by the discharger 129. The positive primary toner image on the drum 105 and the negative secondary toner image on the belt 107 are transferred to a paper sheet S by the negative corona discharge of the charger 108.

EXAMPLE 10

This example is a modification to Example 3 and, therefore, essentially the same as the latter except that in this example primary toner image is composed of a black and a red toner image and, hence, it is formed by a different process. An image is reproduced on the surface of a paper sheet S by Method 32, while an image is reproduced on the back by forming a primary black-and-red toner image on the drum 105 and then processing it by Method 13. How an image is formed on both sides will be described.

Figure 41:
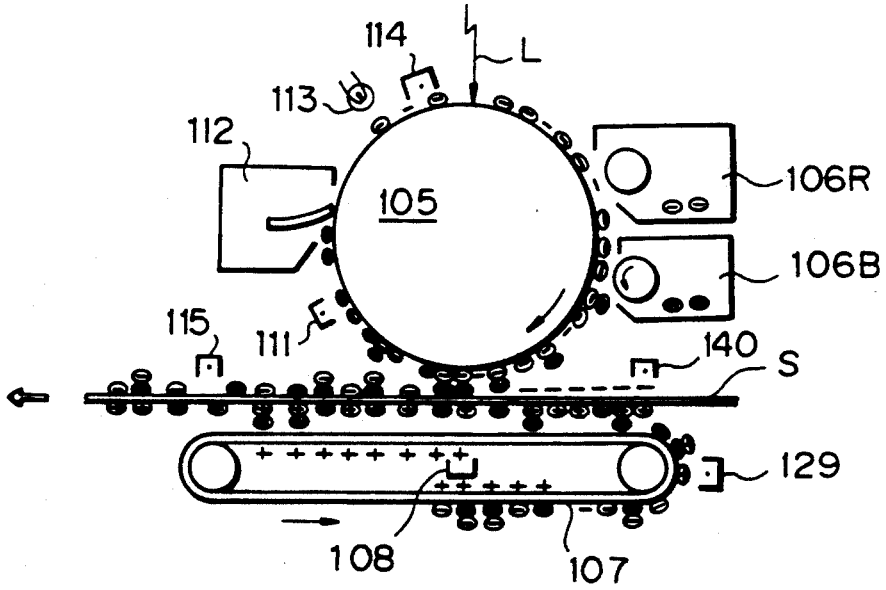

METHOD 36 (see FIG. 41)

This method forms a primary toner image composed of a black and a red toner image on the drum 105 by Method 33 and then transfers it to the belt 107 by Method 7 to form a negative secondary toner image. The secondary toner image is inverted in polarity by the charger 129 to form a positive secondary toner image. On the other hand, a negative primary toner image is formed on the drum 105 by Method 32. As shown in FIG. 41, the secondary toner image on the belt 107 is transferred to the back of a paper sheet S by the second charger 140, while the primary toner image is transferred to the surface of the paper sheet S by the charger 108. As a result, black-and-red images are formed on both sides of the paper sheet S at the same time.

EXAMPLE 11

This example is a modification to example 4 and, therefore, essentially the same as the latter except that the primary toner image is a composite black-and-red image and, hence, it is formed by a different process. An image is formed on the surface of a paper sheet S by Method 32, while an image is formed on the back by forming a primary black-and-red toner image on the drum 105 by Method 33 and processing it by Method 18. How an image is formed on the back of a paper sheet S will be described.

Figure 42:
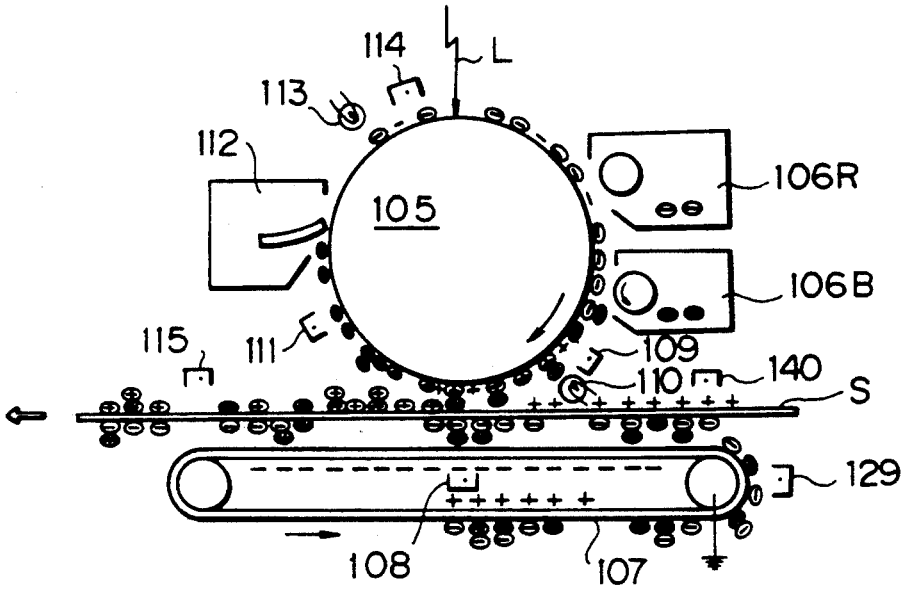

METHOD 37 (see FIG. 42)

Corresponding to Method 19, this method forms an image on both sides of a paper sheet S at the same time and is effected in a composite two-side mode. The charger 108 is switched to positive polarity for the formation of a secondary toner image and to negative polarity for the image transfer to both sides of a paper sheet S.

Process

A primary composite black-and-red toner image is formed on the drum 105 by Method 33 and then transferred to the belt 107 by method 7 to form a negative secondary toner image. The charger 129 discharges the secondary toner image to promote easy transfer. On the other hand, a negative primary toner image is formed on the drum 105 by Method 32. As shown in FIG. 42, the primary toner image is inverted in polarity by the pretransfer charger 109 and then discharged by the discharger 110. The second charger 140 transfers the negative secondary toner image from the belt 107 to the back of a paper sheet S, and then the charger 108 transfers the positive primary toner image from the drum 105 to the surface of the paper sheet S. The paper sheet S carrying images on both sides thereof is separated from the belt 107 by the charger 115 and then transported toward the fixing means.

EXAMPLE 12

This example is a modification to Example 5 and, therefore, essentially the same as the latter except that in this embodiment the primary toner image is a composite black-and-red toner image and, hence, it is formed by a different process. An image is formed on the surface of a paper sheet S by Method 32, while an image is formed on the back by forming a primary red-and-black toner image by Method 33 and then processing it by Method 23. How an image is formed on both sides of a paper sheet will be described.

Figure 43:
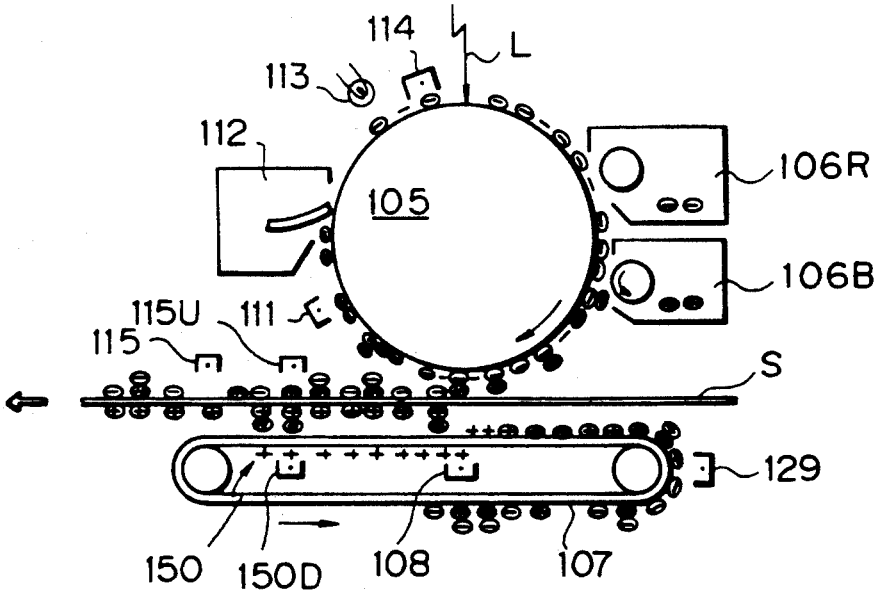

METHOD 38 (see FIG. 43)

Corresponding to Method 24, this method forms images on both sides of a paper sheet S at the same time and is implemented by a composite two-side mode.

Process

A primary black-and-red toner image is formed by Method 33 and then transferred to the belt 107 by Method 7 to form a negative secondary toner image. A negative primary toner image is formed on the drum 105 by Method 32. As shown in FIG. 43, the negative secondary toner image is inverted in polarity by the charger 129 and then brought into register with the back of a paper sheet S. Then, the charger 108 transfers the primary toner image from the drum 105 to the surface of the paper sheet and, at the same time, transfers the secondary toner image from the belt 107 to the back of the paper sheet S. The third chargers 150 further insure the image transfer. The paper sheet S carrying the two-color images on both sides thereof is separated from the belt 107 by the charger 115 and then transported toward the fixing means.

EXAMPLE 13

This example is a modification to Example 6 and, therefore, essentially similar to the latter except that the primary toner image is composed of a plurality of different toner images and, hence, it is formed by a different process. An image is formed on the surface of a paper sheet by Method 32, while an image is formed on the back by forming a primary black-and-red toner image on the drum 105 by method 33 and then processing it by Method 28. How an image is formed on both sides of a paper sheet will be described.

Figure 44:
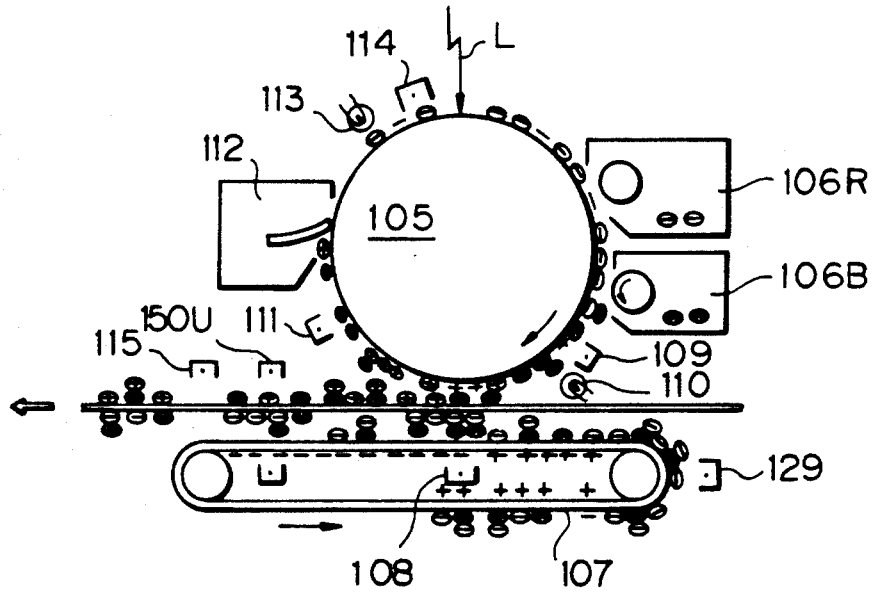

METHOD 39 (see FIG. 44)

Corresponding to Method 29, this method forms an image on both sides of a paper sheet S at the same time and is effected by a composite two-side mode. The charger 108 is switched to positive polarity during the formation of a secondary toner image and to negative polarity during the image transfer to both sides of a paper sheet S.

Process

A primary black-and-red toner image is formed on the drum 105 by Method 33 and then transferred to the belt 107 by Method 7 to form a negative secondary toner image. A negative primary toner image is formed on the drum 105 by Method 32. As shown in FIGS. **45*a*–45*f*, the negative primary toner image is inverted in polarity by the pretransfer charger 109 to form a primary toner image. This image is discharged by the discharger 110. The secondary toner image is transferred from the belt 107 to the back of a paper sheet S by the negative corona discharge of the charger 108, while the primary toner image is transferred from the drum 105 to the surface of the paper sheet S by the charger 108. Third chargers 150 further insure the image transfer to the paper sheet S. The paper sheet S carrying black-and-red images on both sides thereof are separated from the belt 107** and then transported to the fixing means.

Each of Examples 1 to 13 has described above with regard to (A) a method of forming an image on the surface of a paper sheet, (B) a method of forming an image on the back of a paper sheet, and (C) and a method of forming images on both sides of a paper sheet. Advantage attainable with such Examples are as follows.

1. By selecting either one of the methods (A) and (B), a monochromatic, multi-color or full-color image can be formed on a desired side of a paper sheet. This feature is desirable when one wants copies to be stacked face down for privacy reason or wants them to be stacked face up for immediate checking. Also, copy sheets each being produced from one of a plurality of documents can be automatically arranged in order of page.

2. The method (A) allows only a single step suffice for the image transfer to the surface of a paper sheet and thereby maintains a high copying speed, while preserving high quality image reproduction.

3. The method (B) causes a belt or intermediate transfer body to serve as a paper transport belt at the same time. This eliminates troubles often encountered with a prior art black-and-white copier in the event of separation of a paper sheet from a photoconductive element, whereby sheet jams and damage to the photoconductive element are prevented to enhance reliable paper transport. In addition, the construction is inexpensive because no extra transporting members are needed.

4. By the methods (A), (B) and (C), the productivity of copies is enhanced while the image quality and reliability are improved.

5. The method (C) implements a full-color or a multi-color two-sided copy.

6. The method (C) eliminates the dislocation of an image, non-uniform image transfer, and skewing, folding and creasing of a paper sheet which are the most difficult problems to solve with prior art multi-color and full-color copiers.

7. A full-color or multi-color copy carrying an image over its entire area is obtainable because the method (C) eliminates the need for a sheet gripper heretofore used to retain a paper sheet on a photoconductive drum.

8. The methods (A), (B) and (C) allows a paper sheet to be transported straight and allows a belt or intermediate transfer body to transport a paper sheet while electrostatically retaining it thereon, whereby even paper-free transport and the transport of small sizes to large sizes are possible. Further, a black-and-white one-sided copy which is most frequency used in ordinary transactions can be effectively implemented with either side of a paper sheet.

EXAMPLE 14 (see FIGS. 1, 26, 34 and 35)

This example relates to the fixing means 31, 117 and so forth described in the preceding examples. The rollers 117A and 117B constituting the fixing means are each implemented as a heat roller accommodating a heat source therein. Therefore, the fixing process can be completed with a paper sheet carrying a non-fixed toner image on both sides thereof as discussed in various examples by passing it only once through the fixing means. Also, an image formed on either side of a paper sheet can be fixed without turning over the paper. Such an arrangement, therefore, minimizes the influence of thermal contraction and eliminates the dislocation, creases and folds of a paper sheet, compared to the prior art which has to pass a paper sheet twice through a fixing section in which only one of a pair of rollers is implemented as a heat roller. The two rollers eventually increases the service life of such rollers.

Figure 35:
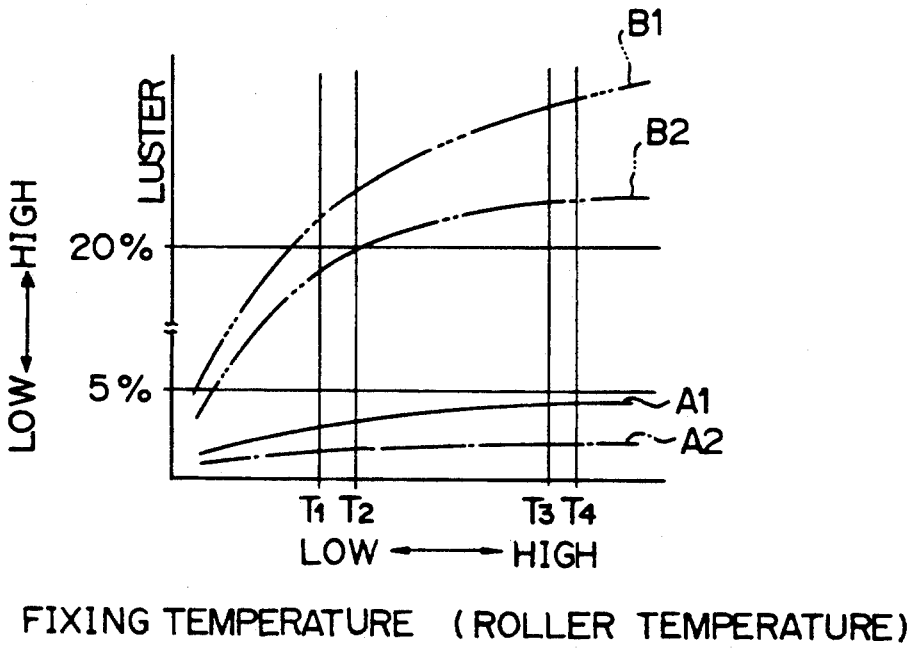
FIG. 35 is a graph showing specific fixing characteristics.

In a modified arrangement, the upper and lower heat rollers are provided with different surface roughnesses. This allows a color image and a black-and-white image which are formed on opposite sides of a paper sheet to have different degrees of luster. Experiments were conducted to determine the degrees of luster of fixed image surfaces attainable with heat rollers having different surface roughnesses as mentioned above. For the experiments, the fixing temperature was changed from a case wherein the amount of toner deposition on an image surface was about 0.3 milligram per square centimeter to a case wherein it was about 1.2 milligrams per square centimeter. The results of experiments are shown in FIG. 35. In FIG. 35, curve B1 indicates a characteristic observed when an image with an amount of toner deposition of 1.2 milligrams per square centimeter was fixed by a roller having a small surface roughness, while curve B2 indicates a characteristic determined when an image with an amount of toner deposition of 0.3 milligrams per square centimeter was fixed by the same rollers as the characteristic B1. Curve A1 as resulted from an image having an amount of toner deposition of 1.2 milligrams per square centimeter and fixed by a roller whose surface roughness was great, while curve A2 was resulted from an image with an amount of toner deposition of 0.3 milligram per square centimeter and fixed by the same roller as the characteristic A1.

When the two rollers are positioned face to face, they share the same temperature in their facing portion including a nipping portion and this is the fixing temperature. It may be said that a "preferable fixing temperature range" which eliminates offsets is the range between temperatures $T_2$ and $T_3$ shown in FIG. 35, i.e., the range higher than a temperature $T_1$ which causes cold offset and lower than a temperature $T_4$ which causes hot offset and having some margins for safety with respect to the critical temperatures $T_1$ and $T_4$.

Concerning luster, the degrees of luster higher than 20% are preferable for full-color images while the degrees of luster lower than 5% are preferably for black-and-white images, as generally accepted. When a pair of fixing rollers are implemented by a roller having great surface roughness and a roller having small surface roughness and share the same temperature in their facing portion as stated above, the roller having a rough surface and the roller having a fine surface are assigned to full-color images and black-and-whit images, respectively.

Figure 34:
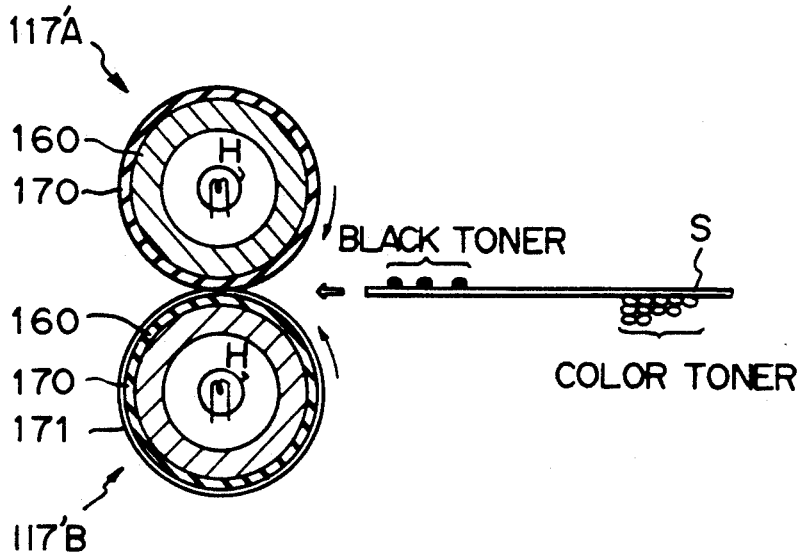
FIG. 34 is a view showing coactive fixing rollers.

Specifically, as shown in FIG. 34, an upper roller 117'A having a rough surface and a lower roller 117'B having a smooth surface are used, while a black toner image and a color toner image are respectively formed on the surface and the back of paper sheet S. In this configuration, the color image achieves the desires degree of luster higher than 20%, and the black-and-white image the desired degree of luster lower than 5%. In this connection, the roller 115'A is made up of a halogen heater H, a core 160 surrounding the heater H and made of A1 or Fe, for example, and a Si rubber layer 170 covering the core 160. The roller 117'B has essentially the same structure as the roller 117'A except for the outermost layer 171 which is provided with a smooth surface by spraying Se rubbers. The Se rubber is selected from a group of rubbers including HTV, RTV and LTV in consideration of partibility, fixing temperature range, durability, etc. To implement a smooth surface, use may be made of surface polishing, spraying coating a parting agent, etc.

As stated above, a roller having a rough surface may be used when a black-and-white copy or similar copy having low luster is desired, while a roller having a smooth surface may be used when a color or similar copy having high luster is desired.

In summary, it will be seen that the present invention provides a simple and compact image recording apparatus capable of forming images on both sides of a paper sheet without the need for special means for turning over the paper sheet. Images transferred to opposite sides of a paper sheet are fixed at the same time when the paper sheet is passed through fixing means only once. A copy, therefore, suffers from a minimum of influence of thermal contraction of paper and is free from the deviation of images as well as from the creases and folds.

Various modifications will become possible for those skilled in the art after receiving the teachings of the present disclosure without departing from the scope thereof.

What is claimed is:

1. An image recording apparatus capable of forming an image freely on the front side and the back side of a recording sheet, comprising:

an image carrier for carrying an electrostatically formed latent image representative of an image to be recorded;

image forming means for forming the latent image on said image carrier as a non-inverted image or an inverted image;

developing means for developing latent images formed on said image carrier by said image forming means to produce a primary toner image;

an intermediate transfer body located to face said image carrier for moving the recording sheet between said intermediate transfer body and said image carrier;

intermediate transferring means for transferring said primary toner image to said intermediate transfer body to form a secondary toner image on said intermediate transfer body;

polarity inverting means for inverting a polarity of said primary toner image such that polarities of said primary and secondary toner images are different from each other;

discharge removing means for dissipating charge of said primary toner image;

primary toner image transferring means for transferring said primary toner image to the recording sheet from said image carrier; and secondary toner image transferring means for transferring said secondary toner image to the recording sheet from said intermediate transfer body, said intermediate transferring means and said primary toner image transferring means being constituted by a single charging unit.

2. An image recording apparatus as claimed in claim 1, in which said intermediate transfer body comprises a belt.

3. An image recording apparatus as claimed in claim 2, in which said single charging unit is disposed between the upper, and lower runs of the belt.

4. An image recording apparatus as claimed in claim 2, further comprising fixing means for fixing a toner image carried on the recording sheet, said belt serving as means for transporting the recording sheet with the toner image to the fixing means.

5. An image recording apparatus as claimed in claim 4, in which said fixing means comprises a pair of rollers which face each other.

6. An image recording apparatus as claimed in claim 5, in which each of said of rollers comprises a heat roller.

7. An image recording apparatus capable of forming an image freely on the front side and the back side of a recording sheet, comprising:

an image carrier for carrying an electrostatically formed latent image representative of an image to be recorded;

image forming means for forming the latent image on said image carrier as a non-inverted image or an inverted image;

developing means for developing latent images formed on said image carrier by said image forming means to produce a primary toner image;

an intermediate transfer body located to face said image carrier for moving the recording sheet between said intermediate transfer body and said image carrier;

intermediate transferring means for transferring said primary toner image to said intermediate transfer body to form a secondary toner image on said intermediate transfer body;

polarity inverting means for inverting a polarity of said primary toner image such that polarities of said primary and secondary toner images are different from each other;

discharge removing means for dissipating charge of said primary toner image;

primary toner image transferring means for transferring said primary toner image to the recording sheet from said image carrier; and secondary toner image transferring means for transferring said secondary toner image to the recording sheet from said intermediate transfer body, said intermediate transferring means, said primary toner image transferring means and second secondary toner image transferring means being constituted by a single charging unit.

8. An image recording apparatus as claimed in claim 7, in which said intermediate transfer body comprises a belt.

9. An image recording apparatus as claimed in claim 8, in which said single charging unit is disposed between the upper and lower runs of the belt.

10. An image recording apparatus as claimed in claim 8, further comprising fixing means for fixing a toner image carried on the recording sheet, said belt serving as means for transporting the recording sheet with the toner image to the fixing means.

11. An image recording apparatus as claimed in claim 10, in which said fixing means comprises a pair of rollers which face each other.

12. An image recording apparatus as claimed in claim 11, in which each of said pair of rollers comprises a heat roller.

* * * * *